US011197543B2

(12) United States Patent
Robinson et al.

(10) Patent No.: US 11,197,543 B2
(45) **Date of Patent: *Dec. 14, 2021**

(54) CANTILEVER SHELVING SYSTEM

(71) Applicant: INTERMETRO INDUSTRIES CORPORATION, Wilkes-Barre, PA (US)

(72) Inventors: Todd Robinson, Nazareth, PA (US); Carey Alan Roberts, Trucksville, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/925,942

(22) Filed: Jul. 10, 2020

(65) Prior Publication Data

US 2020/0405051 A1 Dec. 31, 2020

Related U.S. Application Data

(63) Continuation of application No. 16/580,758, filed on Sep. 24, 2019, now Pat. No. 10,709,237, which is a (Continued)

(30) Foreign Application Priority Data

Feb. 17, 2017 (IN) ..... 201721005649

(51) Int. Cl.
*A47B 57/00* (2006.01)
*A47B 96/06* (2006.01)
(Continued)

(52) U.S. Cl.
CPC ..... *A47B 47/022* (2013.01); *A47B 47/028* (2013.01); *A47B 57/30* (2013.01);
(Continued)

(58) Field of Classification Search
CPC ... A47B 96/028; A47B 96/061; A47B 47/022; A47B 47/028; A47B 57/30; A47B 57/487
See application file for complete search history.

(56) References Cited

U.S. PATENT DOCUMENTS 291,030 A 1/1884 Clapper
309,360 A 12/1884 Roberts
(Continued)

FOREIGN PATENT DOCUMENTS

CN 87105767 A 5/1988
CN 2109133 U 7/1992
(Continued)

OTHER PUBLICATIONS

Cantilever Shelving Unit Assembly Instructions; Nexel Industries; Circa 2011.

(Continued)

*Primary Examiner* — Kimberley S Wright
(74) *Attorney, Agent, or Firm* — Harness, Dickey & Pierce, P.L.C.

(57) ABSTRACT

A cantilever shelving system is disclosed and can include a frame structure, a cantilever shelf support structure, and a plurality of load-bearing shelves that can be supported by the cantilever shelf support structure and the frame structure. The shelves can be positioned laterally adjacent to cantilever support arms of the cantilever shelf support structure, and the shelf support surfaces can be coplanar with upper walls of the cantilever support arms. Ends of laterally adjacent shelves do not overlap with a front side of a vertical support member to which the cantilever support arm is mounted. The cantilever shelving system can accommodate various user requirements and can be operably integrated with standard commercial and/or industrial equipment or machinery.

20 Claims, 23 Drawing Sheets

Related U.S. Application Data continuation-in-part of application No. 16/010,857, filed on Jun. 18, 2018, now Pat. No. 10,426,262, which is a continuation of application No. 15/884,523, filed on Jan. 31, 2018, now Pat. No. 10,021,972.

(60) Provisional application No. 62/859,503, filed on Jun. 10, 2019, provisional application No. 62/746,778, filed on Oct. 17, 2018.

(51) Int. Cl.

| | |
|---|---|
| ***A47B 47/02*** | (2006.01) |
| ***A47B 57/48*** | (2006.01) |
| ***A47B 96/02*** | (2006.01) |
| ***A47B 57/30*** | (2006.01) |
| *A47B 57/40* | (2006.01) |
| *A47B 57/06* | (2006.01) |
| *A47F 5/10* | (2006.01) |
| *A47B 96/14* | (2006.01) |
| *A47B 91/00* | (2006.01) |

(52) U.S. Cl.

CPC ..... *A47B 57/487* (2013.01); *A47B 96/028* (2013.01); *A47B 96/061* (2013.01); *A47B 57/06* (2013.01); *A47B 57/402* (2013.01); *A47B 57/485* (2013.01); *A47B 91/00* (2013.01); *A47B 96/14* (2013.01); *A47F 5/103* (2013.01)

(56) References Cited

U.S. PATENT DOCUMENTS

| | | | |
|---|---|---|---|
| 310,343 | A | 1/1885 | Warren |
| 324,775 | A | 8/1885 | Jones |
| 663,784 | A | 12/1900 | Porter |
| 670,439 | A | 11/1907 | Kade |
| 1,560,122 | A | 11/1925 | Vance |
| 1,582,100 | A | 4/1926 | Troppman |
| 1,620,841 | A | 3/1927 | Vance |
| 1,698,974 | A | 1/1929 | Vance |
| 1,983,858 | A | 12/1934 | Karnes |
| 2,008,180 | A | 7/1935 | Karnes |
| 2,504,800 | A | 4/1950 | Campagna |
| 2,534,952 | A | 12/1950 | Comer |
| 2,632,645 | A | 3/1953 | Barkschat |
| 2,693,884 | A | 11/1954 | Gurries |
| 2,772,846 | A | 12/1956 | Skar |
| 2,875,904 | A | 3/1959 | Gingher et al. |
| 2,912,119 | A | 11/1959 | Robinson |
| 2,919,034 | A | 12/1959 | Levy |
| 2,933,196 | A | 4/1960 | Childs |
| 2,940,603 | A | 6/1960 | Riedmaier |
| 2,971,805 | A | 2/1961 | Weiss |
| 2,975,908 | A | 3/1961 | Huet |
| 2,983,389 | A | 5/1961 | Trautmann |
| 3,018,900 | A | 1/1962 | Huet |
| RE25,156 | E | 4/1962 | Gingher |
| 3,040,905 | A | 6/1962 | Gingher et al. |
| 3,044,632 | A | 7/1962 | Schild |
| 3,044,634 | A | 7/1962 | Oztekin |
| 3,057,483 | A | 10/1962 | Derman |
| 3,097,822 | A | 7/1963 | Attwood |
| 3,127,146 | A | 3/1964 | Fisher |
| 3,130,693 | A | 4/1964 | Shell |
| 3,184,068 | A | 5/1965 | Wende |
| 3,199,822 | A | 8/1965 | Ruhnke |
| 3,207,322 | A | 9/1965 | Pedersen |
| 3,212,648 | A | 10/1965 | Baker, Jr. et al. |
| 3,216,377 | A | 11/1965 | Gunn |
| 3,221,678 | A | 12/1965 | Doherty |
| 3,229,822 | A | 1/1966 | Janus |
| 3,316,863 | A | 5/1967 | Zock |
| 3,471,112 | A | 10/1969 | Macdonald |
| 3,512,654 | A | 5/1970 | Olsen et al. |
| 3,556,306 | A | 1/1971 | Shell |
| 3,565,020 | A | 2/1971 | Schier et al. |
| 3,587,867 | A | 6/1971 | Fenwick |
| 3,595,404 | A | 7/1971 | Goldstein et al. |
| 3,602,159 | A | 8/1971 | Marschak |
| 3,602,374 | A | 8/1971 | Alabaster |
| 3,612,291 | A | 10/1971 | Skubic |
| 3,645,486 | A | 2/1972 | Ferdinand et al. |
| 3,695,569 | A | 10/1972 | Pullan |
| 3,701,325 | A | 10/1972 | Fenwick |
| 3,702,137 | A | 11/1972 | Evans |
| 3,722,702 | A | 3/1973 | Marker, Jr. |
| 3,730,108 | A | 5/1973 | Stroh |
| 3,759,191 | A | 9/1973 | Freeman |
| 3,765,344 | A | 10/1973 | Ferdinand et al. |
| 3,827,377 | A | 8/1974 | Aughtry, Jr. |
| 3,854,686 | A | 12/1974 | Konstant |
| 4,018,167 | A | 4/1977 | Spangler |
| 4,064,996 | A | 12/1977 | Shillum |
| 4,093,078 | A | 6/1978 | Radek |
| 4,098,480 | A | 7/1978 | Neumann |
| 4,101,108 | A | 7/1978 | Klein |
| 4,197,950 | A | 4/1980 | Ovitz, III |
| 4,230,052 | A | 10/1980 | Champagne |
| 4,286,719 | A | 9/1981 | Hall |
| 4,312,086 | A | 1/1982 | Bianco |
| 4,332,204 | A | 6/1982 | Hewell |
| 4,360,181 | A | 11/1982 | Burkholder |
| 4,378,925 | A | 4/1983 | Griffin |
| 4,390,302 | A | 6/1983 | Sanfeliu-Marimon |
| 4,396,125 | A | 8/1983 | Rowader |
| 4,397,432 | A | 8/1983 | Resetar |
| 4,444,323 | A | 4/1984 | Travis |
| 4,592,286 | A | 6/1986 | Trubiano |
| 4,619,427 | A | 10/1986 | Leymann |
| 4,624,376 | A | 11/1986 | Bertram |
| 4,938,442 | A | 7/1990 | Mastrodicasa |
| 4,951,908 | A | 8/1990 | Kallio |
| 4,955,743 | A | 9/1990 | King |
| 4,960,210 | A | 10/1990 | Spamer |
| 5,022,541 | A | 6/1991 | White |
| 5,054,404 | A | 10/1991 | Melgers |
| 5,074,422 | A | 12/1991 | Holtz |
| D331,873 | S | 12/1992 | Finkelstein et al. |
| 5,269,419 | A | 12/1993 | Aldeguer et al. |
| 5,297,486 | A | 3/1994 | Herrmann et al. |
| 5,350,074 | A | 9/1994 | Rosenband |
| 5,365,860 | A | 11/1994 | Billington, III |
| 5,405,114 | A | 4/1995 | Dias |
| D358,321 | S | 5/1995 | Tayar |
| 5,437,426 | A | 8/1995 | MacDonald |
| 5,454,638 | A | 10/1995 | Bird et al. |
| 5,456,435 | A | 10/1995 | Sweeney |
| 5,472,103 | A | 12/1995 | Merl |
| 5,482,168 | A | 1/1996 | Welch et al. |
| 5,522,324 | A | 6/1996 | van Gelder et al. |
| 5,531,168 | A | 7/1996 | Towfigh |
| 5,592,886 | A | 1/1997 | Williams et al. |
| 5,605,238 | A | 2/1997 | Jacobs |
| 5,611,440 | A | 3/1997 | Møller |
| 5,613,449 | A | 3/1997 | Pullman |
| 5,645,257 | A | 7/1997 | Ward |
| 5,655,740 | A | 8/1997 | Lazarus |
| 5,695,163 | A | 12/1997 | Tayar |
| 5,794,902 | A | 8/1998 | Henry et al. |
| 5,797,501 | A | 8/1998 | Von Gunten |
| 5,833,083 | A | 11/1998 | Miller |
| 5,868,263 | A | 2/1999 | McAllister et al. |
| 5,908,119 | A | 6/1999 | Kump et al. |
| 5,921,190 | A | 7/1999 | Wood |
| 5,921,414 | A | 7/1999 | Burke et al. |
| D415,365 | S | 10/1999 | Nicklas |
| 5,979,677 | A | 11/1999 | Simpson, II et al. |
| 6,019,331 | A | 2/2000 | Hoogland et al. |
| 6,024,333 | A | 2/2000 | Raasch et al. |
| 6,029,833 | A | 2/2000 | Yeh |
| 6,053,115 | A | 4/2000 | Felton |
| 6,062,401 | A | 5/2000 | Hall et al. |

(56) References Cited

U.S. PATENT DOCUMENTS

| | | | |
|---|---|---|---|
| 6,082,690 | A | 7/2000 | Durin et al. |
| 6,109,461 | A | 8/2000 | Kluge et al. |
| 6,129,224 | A | 10/2000 | Mingers |
| 6,158,599 | A | 12/2000 | Lazarus |
| 6,230,907 | B1 | 5/2001 | Stuart |
| 6,267,064 | B1 | 7/2001 | Ostertag et al. |
| 6,269,906 | B1 | 8/2001 | Dockter et al. |
| 6,302,283 | B1 | 10/2001 | Yeh |
| 6,345,795 | B1 | 2/2002 | Bartz, Jr. |
| D462,541 | S | 9/2002 | Welch |
| 6,460,946 | B1 | 10/2002 | Beukema |
| 6,584,916 | B1 | 7/2003 | Felton et al. |
| 6,666,344 | B1 | 12/2003 | Schneider |
| 6,675,725 | B2 | 1/2004 | Felton et al. |
| 6,721,969 | B1 | 4/2004 | Lupo et al. |
| RE38,517 | E | 5/2004 | Pfeiffer et al. |
| 6,880,185 | B1 | 4/2005 | McAdams |
| 6,918,499 | B2 | 7/2005 | De Land et al. |
| 7,036,160 | B1 | 5/2006 | Pecoraro |
| 7,191,908 | B2 | 3/2007 | De Rijk |
| 7,240,803 | B2 | 7/2007 | Stitchick et al. |
| 7,258,317 | B1 | 8/2007 | Nagel |
| 7,407,060 | B2 | 8/2008 | Swartz et al. |
| 7,494,019 | B2 | 2/2009 | Kessell et al. |
| 7,497,344 | B2 | 3/2009 | Chen |
| 7,523,903 | B1 | 4/2009 | Rindoks et al. |
| 7,900,783 | B2 | 3/2011 | Fernandez et al. |
| 8,028,846 | B2 | 10/2011 | Peota et al. |
| D702,467 | S | 4/2014 | Huang et al. |
| 8,967,576 | B2 | 3/2015 | Knoll et al. |
| 9,119,471 | B2 | 9/2015 | Gonzalez et al. |
| 9,277,814 | B2 | 3/2016 | Winker |
| 9,339,108 | B2 | 5/2016 | Zang et al. |
| 9,770,122 | B2 | 9/2017 | Gonzalez et al. |
| D808,200 | S | 1/2018 | Davis et al. |
| 9,883,755 | B2 | 2/2018 | Gonzalez et al. |
| 10,159,339 | B1 | 12/2018 | Powell et al. |
| 2001/0030849 | A1 | 10/2001 | Garnica |
| 2003/0037712 | A1 | 2/2003 | Welch et al. |
| 2003/0160012 | A1 | 8/2003 | Kanouchi et al. |
| 2003/0233965 | A1 | 12/2003 | Brazier |
| 2003/0234231 | A1 | 12/2003 | Rowe |
| 2004/0045919 | A1 | 3/2004 | Remmers |
| 2004/0050814 | A1 | 3/2004 | Roush et al. |
| 2004/0154498 | A1 | 8/2004 | Borgen et al. |
| 2004/0159622 | A1 | 8/2004 | Craft et al. |
| 2004/0173549 | A1 | 9/2004 | Herron et al. |
| 2004/0182805 | A1 | 9/2004 | Harper |
| 2005/0045787 | A1 | 3/2005 | Magnusson |
| 2005/0092706 | A1 | 5/2005 | Chang |
| 2005/0103733 | A1 | 5/2005 | Saltzberg et al. |
| 2005/0103734 | A1 | 5/2005 | Saltzberg et al. |
| 2005/0127017 | A1 | 6/2005 | Kessel et al. |
| 2005/0145588 | A1 | 7/2005 | Stitchick et al. |
| 2005/0150850 | A1 | 7/2005 | Stitchick et al. |
| 2005/0199568 | A1 | 9/2005 | Gay et al. |
| 2006/0175495 | A1 | 8/2006 | Gregory |
| 2006/0213849 | A1 | 9/2006 | Bienick |
| 2007/0241072 | A1 | 10/2007 | Bryant et al. |
| 2007/0295681 | A1 | 12/2007 | Colin |
| 2008/0047914 | A1 | 2/2008 | Young |
| 2008/0217496 | A1 | 9/2008 | Wooten |
| 2010/0096529 | A1 | 4/2010 | Kritsky |
| 2010/0140202 | A1 | 6/2010 | Janis |
| 2010/0155353 | A1 | 6/2010 | McAllister et al. |
| 2010/0269254 | A1 | 10/2010 | Sanders, Jr. |
| 2012/0055897 | A1 | 3/2012 | Li |
| 2012/0175330 | A1 | 7/2012 | Nicholls et al. |
| 2012/0273447 | A1 | 11/2012 | Stitchick et al. |
| 2013/0000037 | A1 | 1/2013 | Tabbia |
| 2014/0263125 | A1 | 9/2014 | Gonzalez et al. |
| 2015/0335155 | A1 | 11/2015 | Winker |
| 2016/0015174 | A1 | 1/2016 | Guizzardi et al. |
| 2017/0310090 | A1 | 10/2017 | Woodley et al. |
| 2017/0340142 | A1 | 11/2017 | Gonzalez et al. |
| 2019/0380492 | A1 | 12/2019 | Heap et al. |

FOREIGN PATENT DOCUMENTS

| | | | |
|---|---|---|---|
| CN | 201226994 | Y | 4/2009 |
| CN | 104305735 | A | 1/2015 |
| CN | 204336332 | U | 5/2015 |
| CN | 204635593 | U | 9/2015 |
| CN | 205065190 | U | 3/2016 |
| CN | 105722435 | A | 6/2016 |
| DE | 1210529 | B | 2/1966 |
| DE | 1955865 | A1 | 5/1971 |
| DE | 7715472 | U1 | 12/1977 |
| DE | 2721966 | A1 | 11/1978 |
| DE | 2824605 | A1 | 12/1979 |
| DE | 8904376 | U1 | 1/1990 |
| DE | 19707892 | A1 | 10/1997 |
| DE | 20215552 | U1 | 2/2003 |
| FR | 2087404 | A5 | 12/1971 |
| FR | 2461841 | A1 | 2/1981 |
| FR | 2568758 | A1 | 2/1986 |
| FR | 2601569 | A1 | 1/1988 |
| GB | 504789 | A | 4/1939 |
| GB | 593204 | A | 10/1947 |
| GB | 608480 | A | 9/1948 |
| GB | 983979 | A | 2/1965 |
| GB | 1153448 | A | 5/1969 |
| GB | 1360895 | A | 7/1974 |
| GB | 2067706 | A | 7/1981 |
| WO | 95/029613 | A1 | 11/1995 |
| WO | 9609451 | A2 | 3/1996 |
| WO | 03/088782 | A2 | 10/2003 |
| WO | 2013/071977 | A1 | 5/2013 |

OTHER PUBLICATIONS

Complaint for Case 3:18-cv-00116 filed Feb. 6, 2018; *SPG International, LLC* vs. *InterMetro Industries Corp.*

Corrosion Resistant Cantilever Rack—Adjustable Width Uprights & Frame (Only); https://www.globalindustrial.com/p/storage/bulk-rack/cantilever/corrosion-resistant-cantilever-rack-upright; Global Industrial website; Circa 2011.

"HD Super Work Center With Overhead" specification sheet; InterMetro Industries Corporation, Sep. 2000.

"Super Erecta Shelf Post—Type and Direct Wall Mounts" specification sheet; InterMetro Industries Corporation, Apr. 2011.

Sep. 6, 2016 Freestyle Modular Cantilever Shelving System by SPG—9 page specification.

"Button-On Cantilever Rack"; https://web.archive.org/web/20061019070526/http://www.jarke.com/pro . . . ; Jarke—division of Leggett & Platt; 2006.

"Cantilever Shelving" brochure; Eagle Group; Mar. 2005.

"Cantilever Shelving System—Heavy Duty Components" specification sheet; Eagle Group, Sep. 2010.

"Chapter 3—Installing FlexWorks Accessories"; Lista International Corporation; May 2000.

"FreedomRail Installation Guide"; OrganizedLiving; 2009.

"Shelving and Shelving Solutions" brochure; Eagle Group; Apr. 2009.

"Wire Basket with Brackets 36" x 16""; https://web.archive.org/web/20120507140028/http://www.globalindustria . . . ; Global Equipment Company Inc.; 2012.

"Storage Racks" Standard Product Catalog; SPG International, LLC; 2010.

Extended European Search Report for EP 18156976.5, conducted May 4, 2018, EPO.

"Metro Workspace™ Adjustable Workstations"; InterMetro Industries Corp.; 2001.

CANTILEVER SHELVING SYSTEM

CROSS-REFERENCE TO RELATED APPLICATIONS

This application is a continuation of U.S. patent application Ser. No. 16/580,758, filed Sep. 24, 2019 to issue as U.S. Pat. No. 10,709,237 on Jul. 14, 2020; which claims benefit to U.S. Provisional Application No. 62/859,503, filed on Jun. 10, 2019 and of U.S. Provisional Application No. 62/746,778, filed on Oct. 17, 2018; and is a continuation-in-part of U.S. patent application Ser. No. 16/010,857 filed on Jun. 18, 2018, now U.S. Pat. No. 10,426,262, which is a continuation of U.S. patent application Ser. No. 15/884,523 filed on Jan. 31, 2018, now U.S. Pat. No. 10,021,972, which claims the benefit and priority of IN201721005649, filed Feb. 17, 2017. The entire disclosures of all of the above applications are incorporated herein by reference.

FIELD

The present disclosure relates to cantilever shelving systems and storage rack assemblies.

BACKGROUND

This section provides background information related to the present disclosure which is not necessarily prior art.

Cantilever shelving systems and storage rack assemblies are readily adaptable for supporting and storing a variety of items and have found widespread use in industrial, commercial and residential applications.

Many existing cantilever shelving systems and storage rack assemblies include frames and shelves having fixed dimensions in well-known standard sizes which cannot be adapted or modified to accommodate various and changing customer requirements. Further, known shelving units do not readily accommodate integration with standard-sized industrial and/or commercial equipment with which the shelving system may be associated during use. Consequently, these shelving systems and storage rack assemblies offer limited flexibility in configuration and use.

SUMMARY

This section provides a general summary of the disclosure, and is not a comprehensive disclosure of its full scope or all of its features.

In one aspect of the disclosure, a cantilever shelving system of the type that is freestanding on a floor surface, the cantilever shelving system is disclose and includes a frame having a plurality of laterally-spaced support members extending along a vertical axis, a plurality of base supports adapted to engage the floor surface extending generally orthogonal to the vertical axis, wherein each of the plurality of base supports is connected to a corresponding one of the plurality of support members, at least one cantilever shelf support mounted a corresponding one of the plurality of support members and having an elongated portion extending generally orthogonal to the vertical axis and a side wall with a pair of vertical slots in the side wall, a shelf support fitting removably attached to the cantilever shelf support at the slots, a shelf engaging the shelf support fitting, and a wedge member disposed between the side wall of the cantilever shelf support and the shelf support fitting preventing the shelf support fitting from detaching from the cantilever shelf support.

The wedge member can include a tapered leading portion configured to guide the wedge member into a seated position between the cantilever shelf support the shelf support fitting. The wedge member can be disposed between the side wall of the cantilever shelf support and the shelf support fitting with an interference fit. The wedge member can also include at least one pad projecting away from a body portion of the wedge member which is adapted to engage at least one of the slots in the side wall of the cantilever support member when the wedge member is in a seated position.

In another aspect of the disclosure, the support members include a front side, a back side, opposing lateral sides and plurality of vertically-spaced hanger pins projecting outwardly from the opposing lateral sides, the cantilever shelf support further has a mounting flange including two opposing lateral side braces and a connecting portion between the side braces, and the side braces include a finger portion extending rearward and upward from a rear end of the mounting flange. When mounted to the frame, the finger portion extends along a lateral side and between first and second vertically-adjacent hanger pins. A first end of each finger portion bears against a side of a hanger pin nearer the back side of the support member. The side braces have a rearward-facing edge extending vertically downwardly from the finger portion and a second end of each finger portion and the rearward-facing edge bears against a hanger pin.

In still another aspect of the disclosure, the second end of the finger portion has a base edge that bears against a hanger pin having a radius that is substantially the same as a radius of the hanger pin.

In some instances, the rearward-facing edge extends vertically below a lower hanger pin and bears against a side of the hanger pin nearer the front side of the support member. In other instances, the rearward-facing edge extends vertically below a still lower hanger pin and bears against a side of the third hanger pin nearer the front side of the support member.

In still another aspect of the disclosure, a cantilever shelving system of the type that is freestanding on a floor surface is disclosed as including a frame comprising a plurality of laterally-spaced, vertically-oriented tubular support members, the support members including a front side, a back side, opposing lateral sides and plurality of vertically-spaced hanger pins projecting outwardly from the opposing lateral sides, a plurality of base supports adapted to engage the floor surface, wherein each of the plurality of base supports is connected to a corresponding one of the plurality of support members, and a cantilever shelf support mounted to the frame, the cantilever shelf support including a mounting flange including two opposing lateral side braces and a connecting portion between the side braces, wherein each of the side braces comprises a finger portion extending rearward and upward from a rear end of the mounting flange. When mounted to the frame, each finger portion of the opposing side braces extends along a respective opposing lateral side and between first and second vertically-adjacent hanger pins of the plurality of vertically-spaced hanger pins of a corresponding support member. A first end of each finger portion bears against a side of the first hanger pin nearer the back side of the support member and each of the side braces further has a rearward-facing edge extending vertically downwardly from the finger portion. A second end of each finger portion and the rearward-facing edge bears against the second hanger pin. The cantilever shelf support further includes an elongated portion extending outward from and in a direction generally orthogonal to the support members and having a side wall and at least one slot in the side wall. At least one shelf support fitting is attached to the cantilever shelf support at the at least one slot and a horizontal shelf engages the at least one shelf support fitting.

In some instances, the the second end of the finger portion has a first base edge having a radius substantially the same as a radius of the second hanger pin that bears against the second hanger pin. In some instances, the rearward-facing edge extends vertically below the second hanger pin and bears against a side of the second hanger pin nearer the front side of the support member.

In some instances, each of the side braces further includes a second finger portion having a second base edge with an arcuate portion that bears against a third hanger pin of the plurality of vertically-spaced hanger pins of the corresponding support member that is located vertically below the second hanger pin. The arcuate portion can be a radius greater than a radius of the third hanger pin. Alternatively, the arcuate portion can be a radius substantially the same as a radius of the third hanger pin.

In other aspects of the invention, an anti-rotation member can be attached to the cantilever shelf support which, in an installed position, bears against a fourth hanger pin of the plurality of vertically-spaced hanger pins of the corresponding support member which is located vertically below the third hanger pin. The anti-rotation member can have a body and two opposed lateral side arms, each lateral side arm extending from the body from a proximal end to a distal end. In the installed position, each lateral side arm can extend along a respective opposing lateral side of the corresponding support member. Further each lateral side arm can bear against a side of the fourth hanger pin nearer the back side of the support member.

In yet other aspects of the disclosure, the rearward-facing edge extends vertically below a third hanger pin of the plurality of vertically-spaced hanger pins of the corresponding support member and bears against a side of the third hanger pin nearer the front side of the support member.

In still other aspects of the disclosure, the distal end of each lateral side arm can have a ramped engagement portion which, in the installed position, bears against a respective one of the opposing lateral sides of the corresponding support member. The distal end of each lateral side arm can also have a forward-facing edge which bears against the side of the fourth hanger pin nearer the back side of the support member.

Still further, the elongated portion of the cantilever shelf support can have a pair of opposing lateral side walls defining a downwardly open channel, each of the pair of opposing side walls comprising an aperture near a proximal end thereof. The body of the anti-rotation member can have two opposing walls, each have a protrusion thereon. The anti-rotation member can be disposed within the downwardly open channel and the protrusion on each opposing wall of the body can engage the aperture in a corresponding side wall of the elongated portion of the cantilever shelf support. The anti-rotation member is then pivotable about an axis extending through the protrusions on the opposing walls of the body of the anti-rotation member.

In another aspect, the body of the anti-rotation member can include a stiffener located between the opposing walls of the body. Still further, at least one of the side braces can have a second aperture therein and at least one of the lateral side arms can have a second protrusion nearer to the proximal end thereof. The second protrusion is configured to engage the second aperture and, when engaged, the anti-rotation member is prevented from pivoting about the axis extending through the protrusions on the opposing walls of the body of the anti-rotation member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 26:
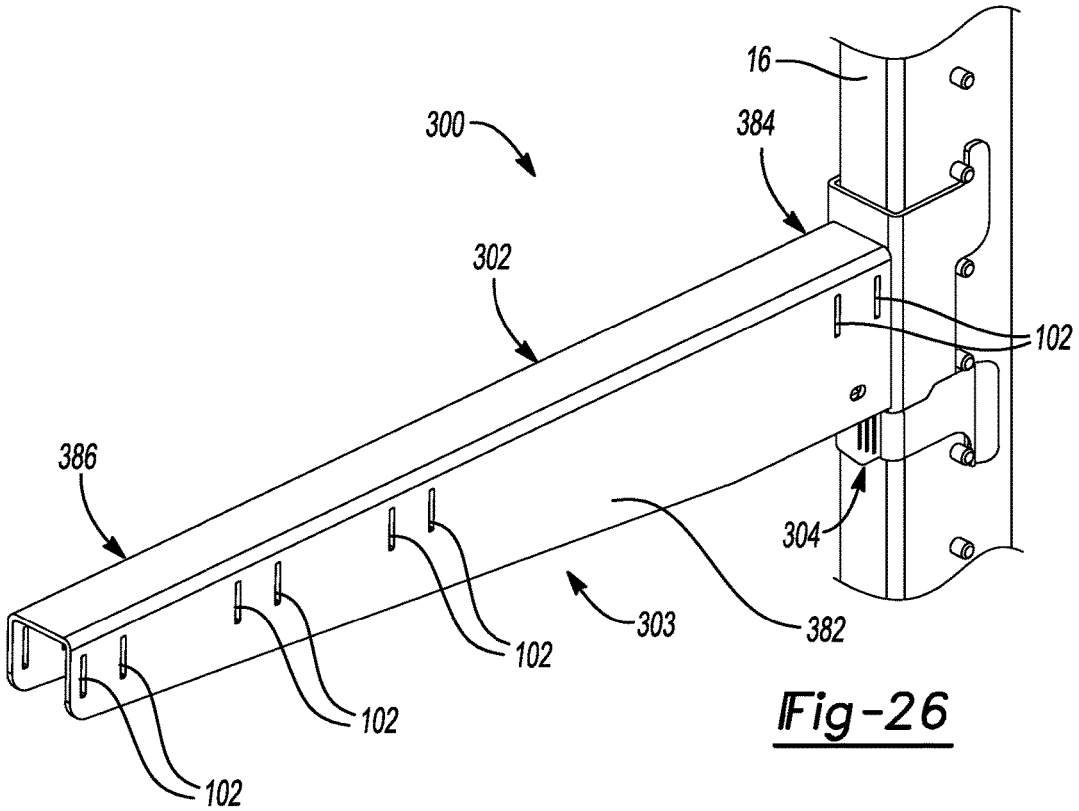
FIG. 26 shows a top-front perspective view of a horizontal cantilever support arm assembly for the cantilever shelving system according to the principles of the present disclosure in an installed position on a support member and including the horizontal cantilever support arm as shown in FIG. 22 and an anti-rotation member.
Figure 32A:
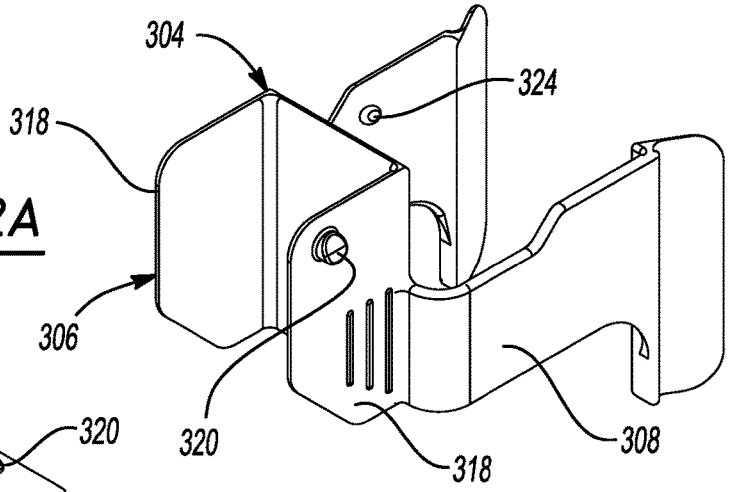
FIGS. 32A and 32B show top-front-right and bottom-front-right perspective views, respectively, of the anti-rotation member of the cantilever support arm assembly of FIG. 26.
Figure 34B:
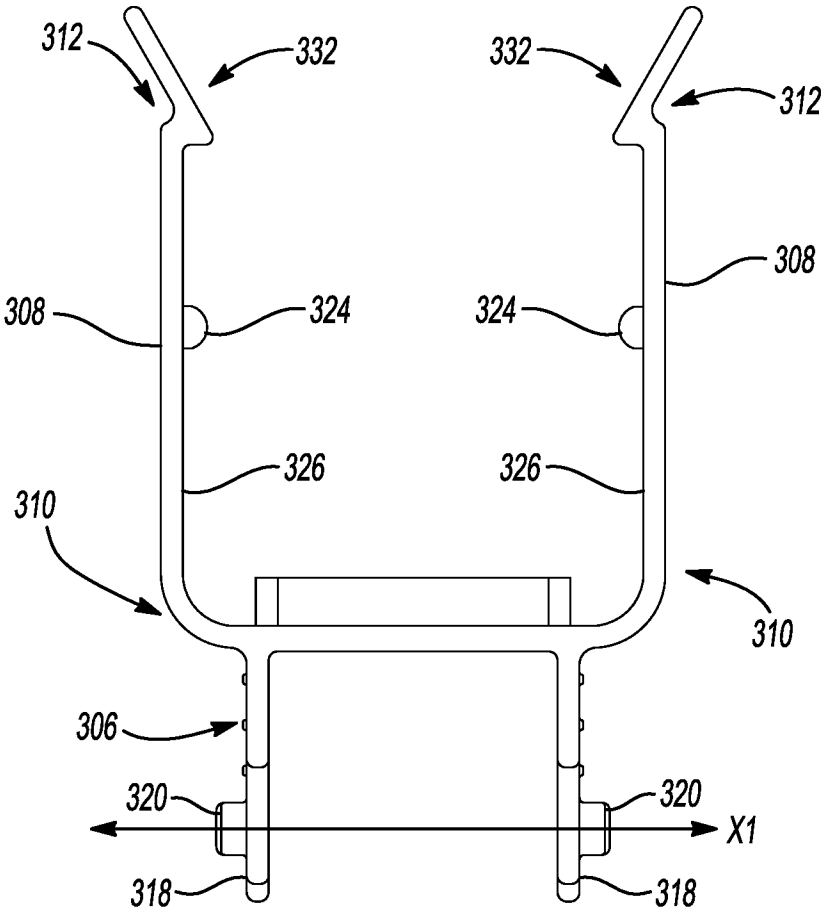
Figure 34A:
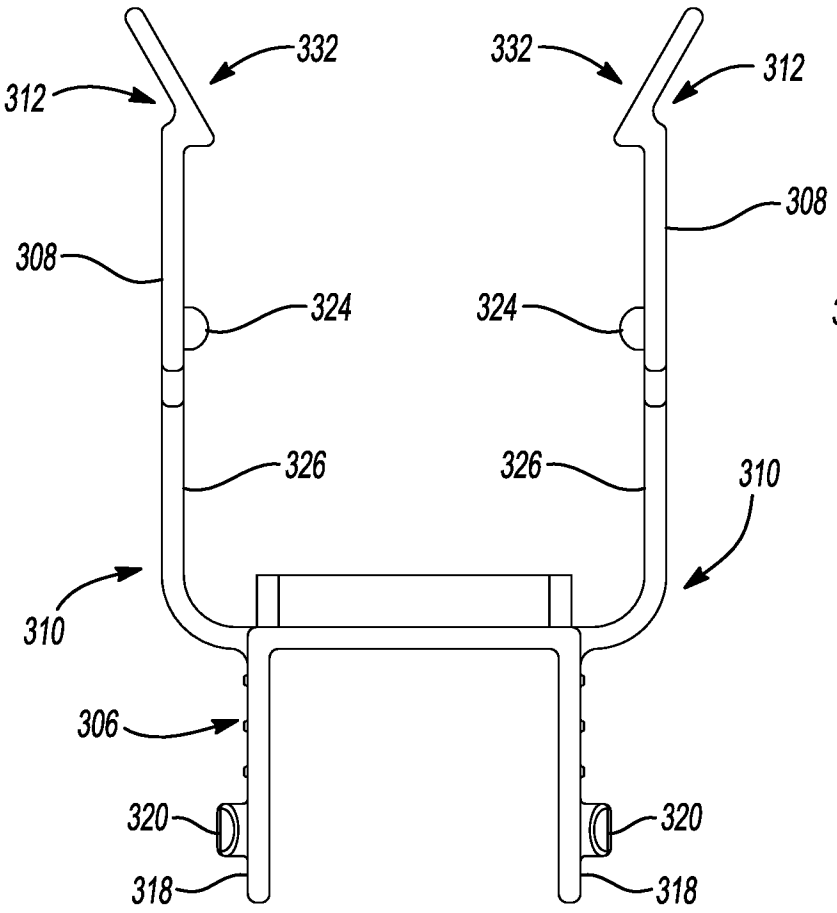
Figure 35B:
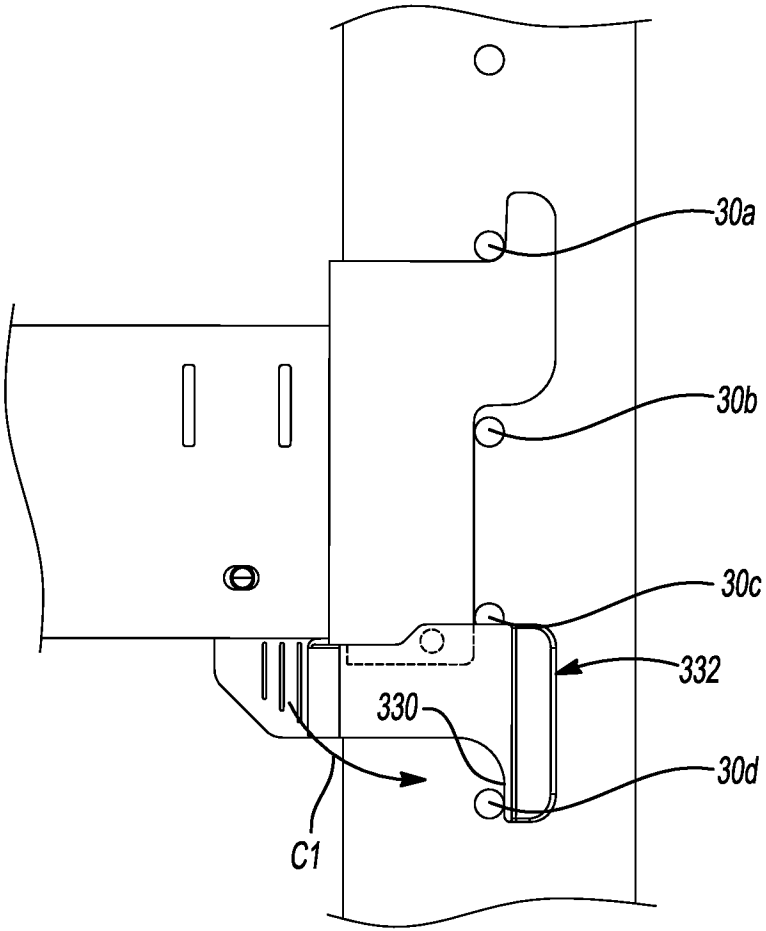
Figure 35A:
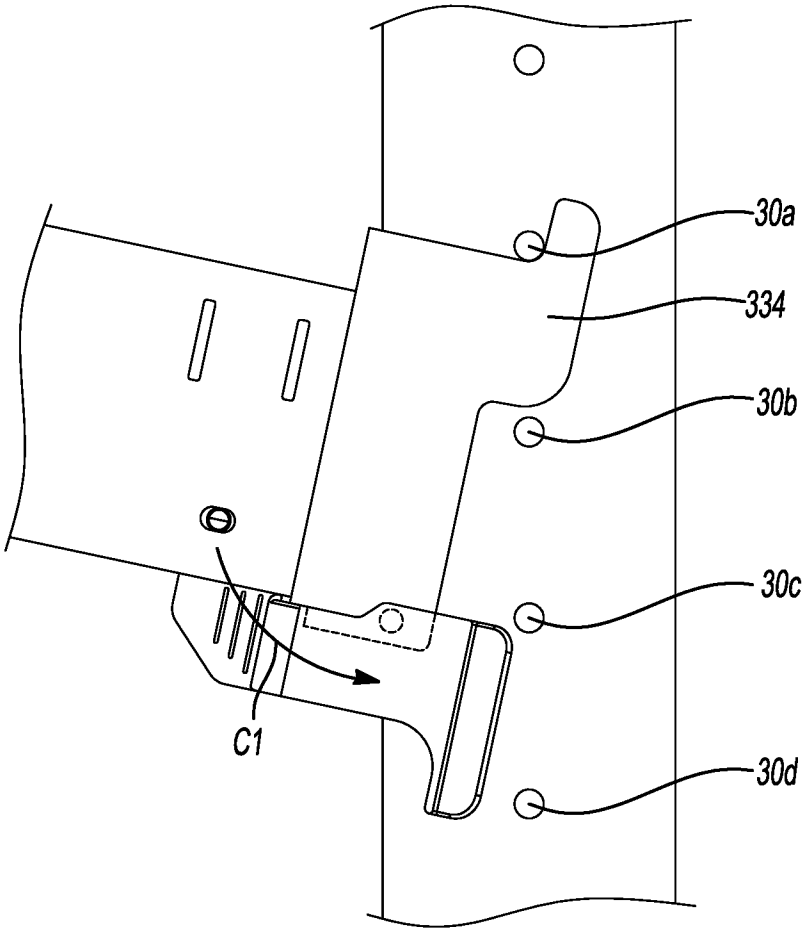
Figure 36B:
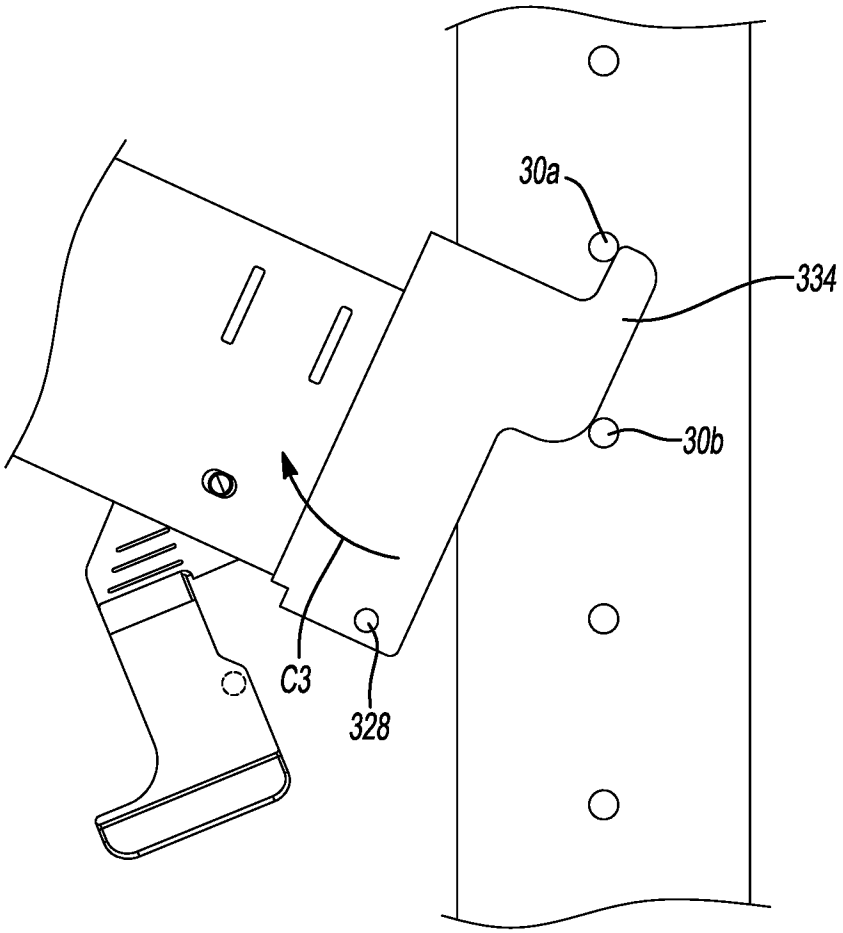
Figure 36A:
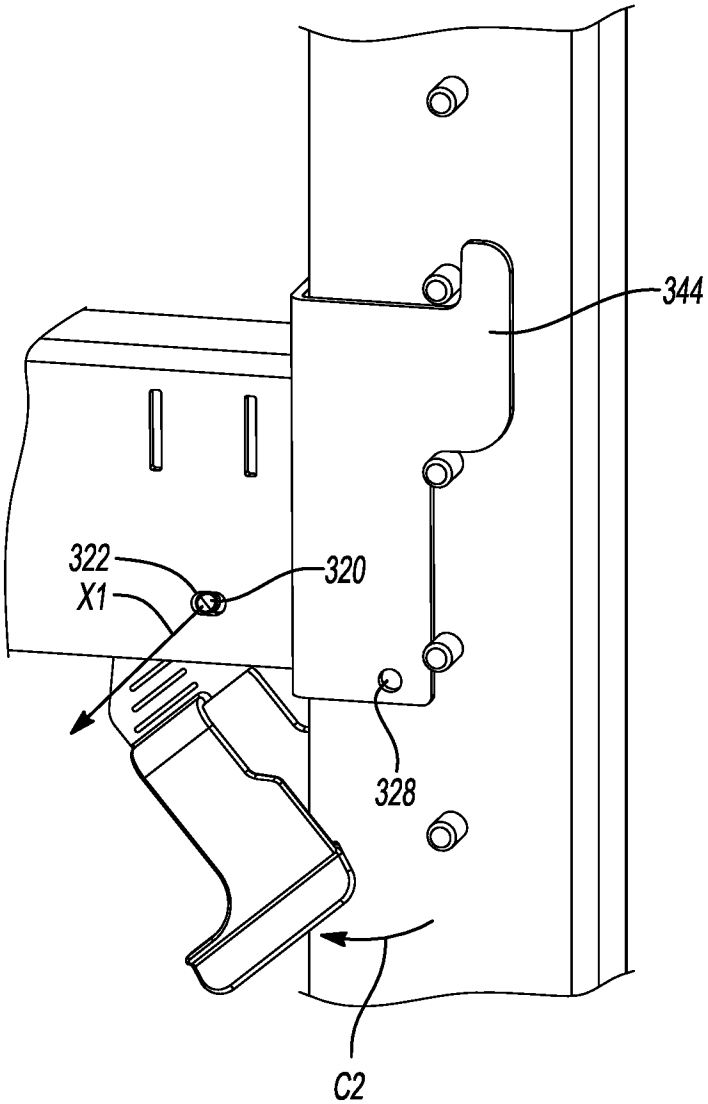
Figure 37:
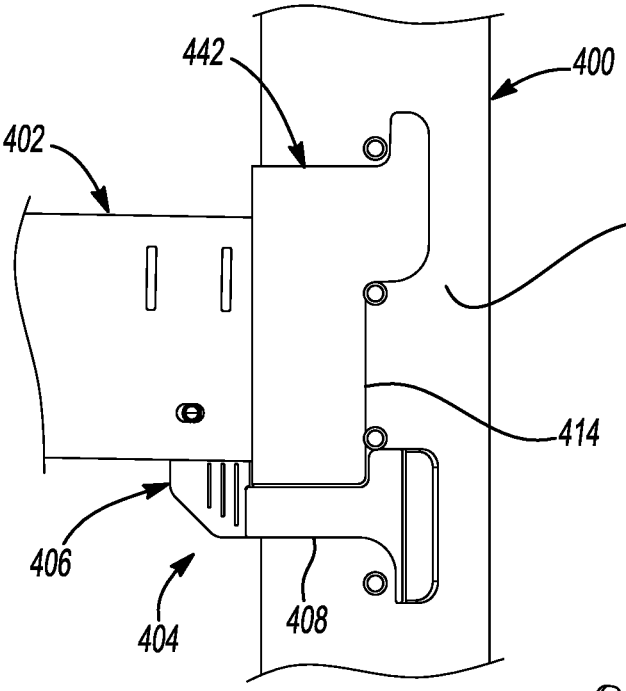
Figure 38A:
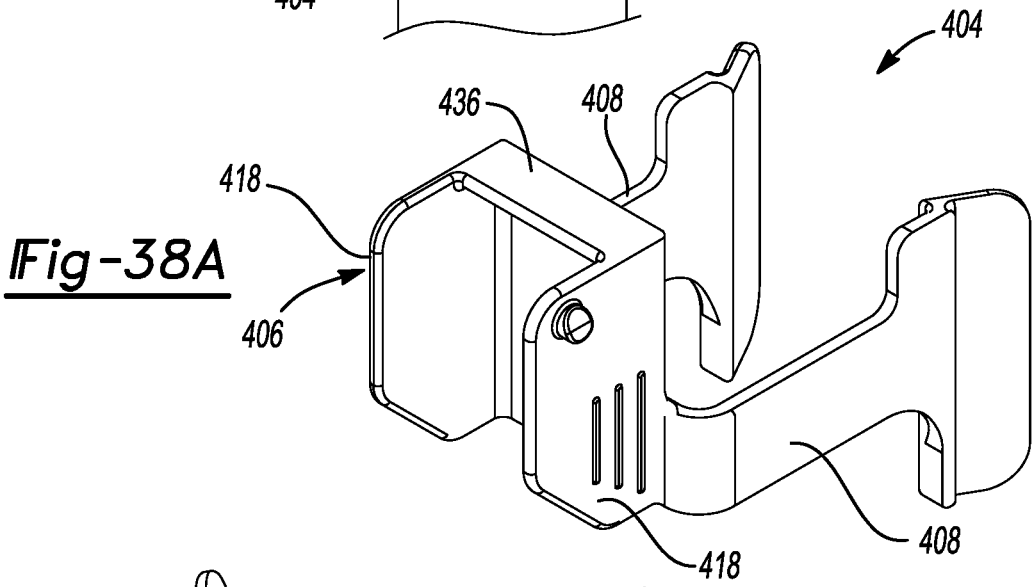
Figure 38B:
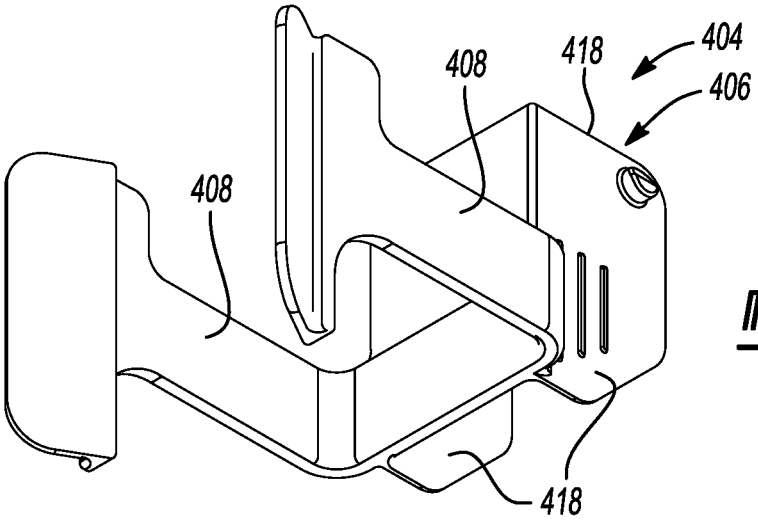
Figure 39B:
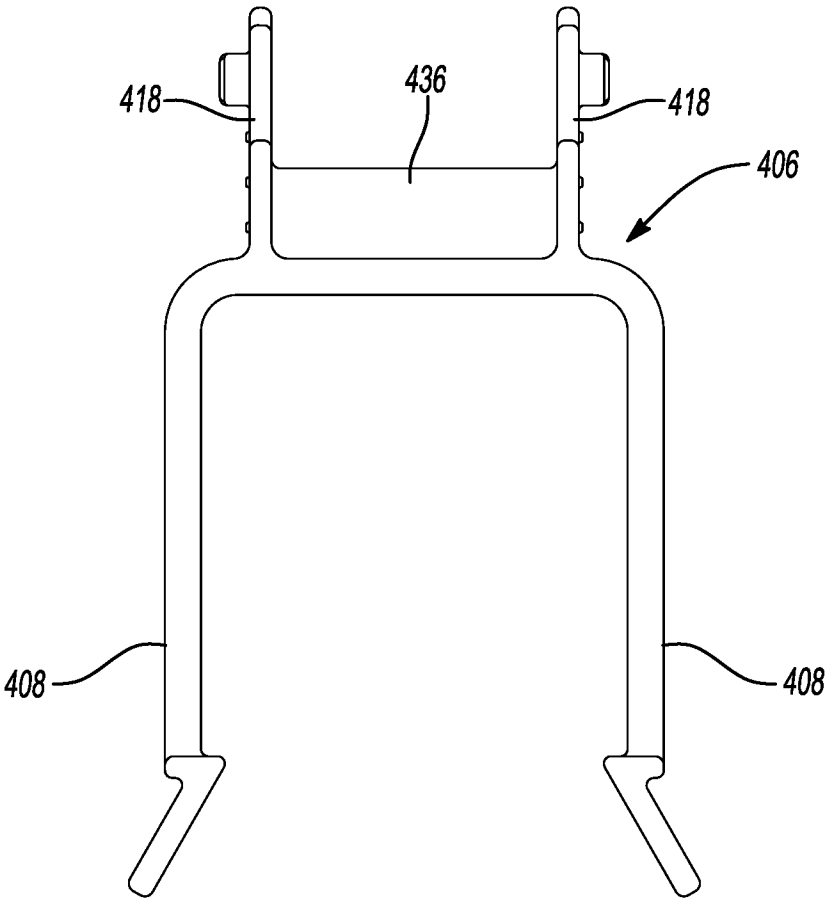
Figure 39A:
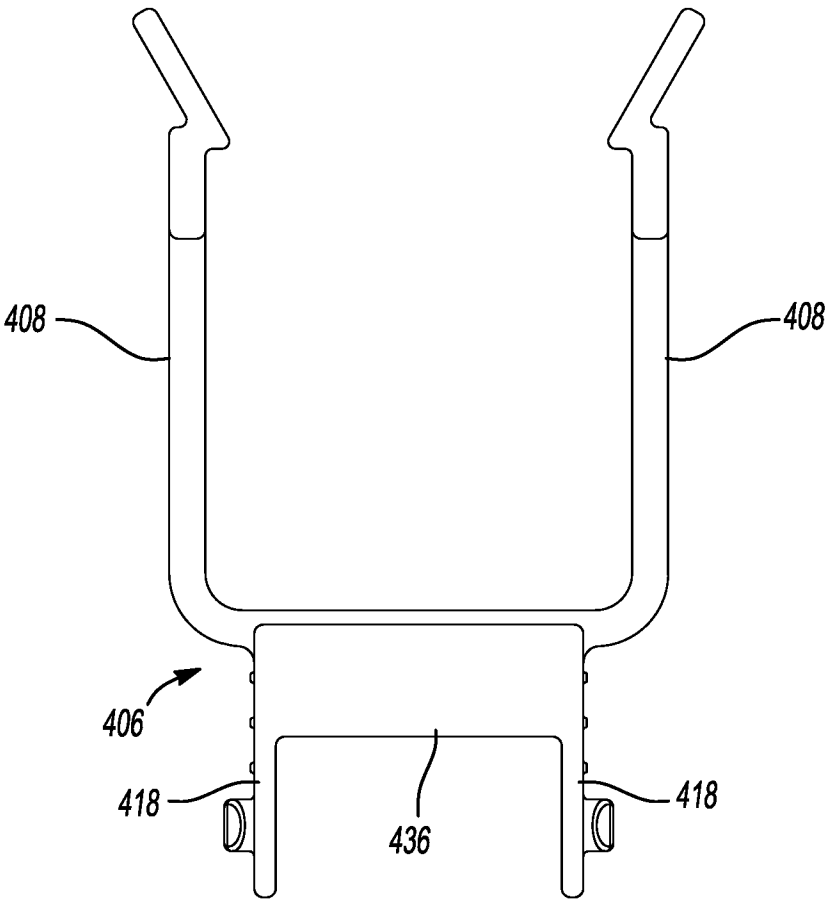

FIGS. 34A and 34B top and bottom views, respectively, of the anti-rotation member of FIG. 32A;

FIGS. 35A and 35B show an installation of the horizontal cantilever support arm assembly of FIG. 26 onto a support member according to the principles of the present disclosure;

FIGS. 36A and 36B show removal of the horizontal cantilever support arm assembly of FIG. 26 from a support member according to the principles of the present disclosure;

FIG. 37 shows a partial front view of another horizontal cantilever support arm assembly for the cantilever shelving system according to the principles of the present disclosure in an installed position on a support member and including an alternative embodiment of an anti-rotation member according to the principles of the present disclosure;

FIGS. 38A and 38B show top-front-right and bottom-left-rear perspective views, respectively, of the anti-rotation member of the cantilever support arm assembly of FIG. 37; and FIGS. 39A and 39B show top and bottom views, respectively, of the anti-rotation member of FIG. 37.

Corresponding reference numerals indicate corresponding parts throughout the several views of the drawings.

DETAILED DESCRIPTION

Example embodiments will now be described more fully with reference to the accompanying drawings.

An exemplary cantilever shelving system 1 according to the principles of the present disclosure is shown and understood with reference to FIGS. 1-11. The cantilever shelving system 1 of the present disclosure can provide multiple, vertically-arranged and horizontally-oriented load-bearing platforms for supporting and/or storing items in a workspace or storage area. The cantilever shelving system 1 of the present disclosure can be easily adapted or modified to accommodate various and changing user requirements, and can readily accommodate operable integration with standard-sized industrial and/or commercial equipment with which the shelving system may be associated during use.

With reference to the figures, the cantilever shelving system 1 of the present disclosure can generally include a frame structure 10, a cantilever shelf support structure 12, and a plurality of load-bearing shelves 14 that can be supported by the cantilever shelf support structure 12 and the frame structure 10.

The frame structure 10 can generally include at least two vertically oriented or upright support members 16, a lateral support structure 18 interconnecting the upright support members 16, and a base 20.

Figure 1:
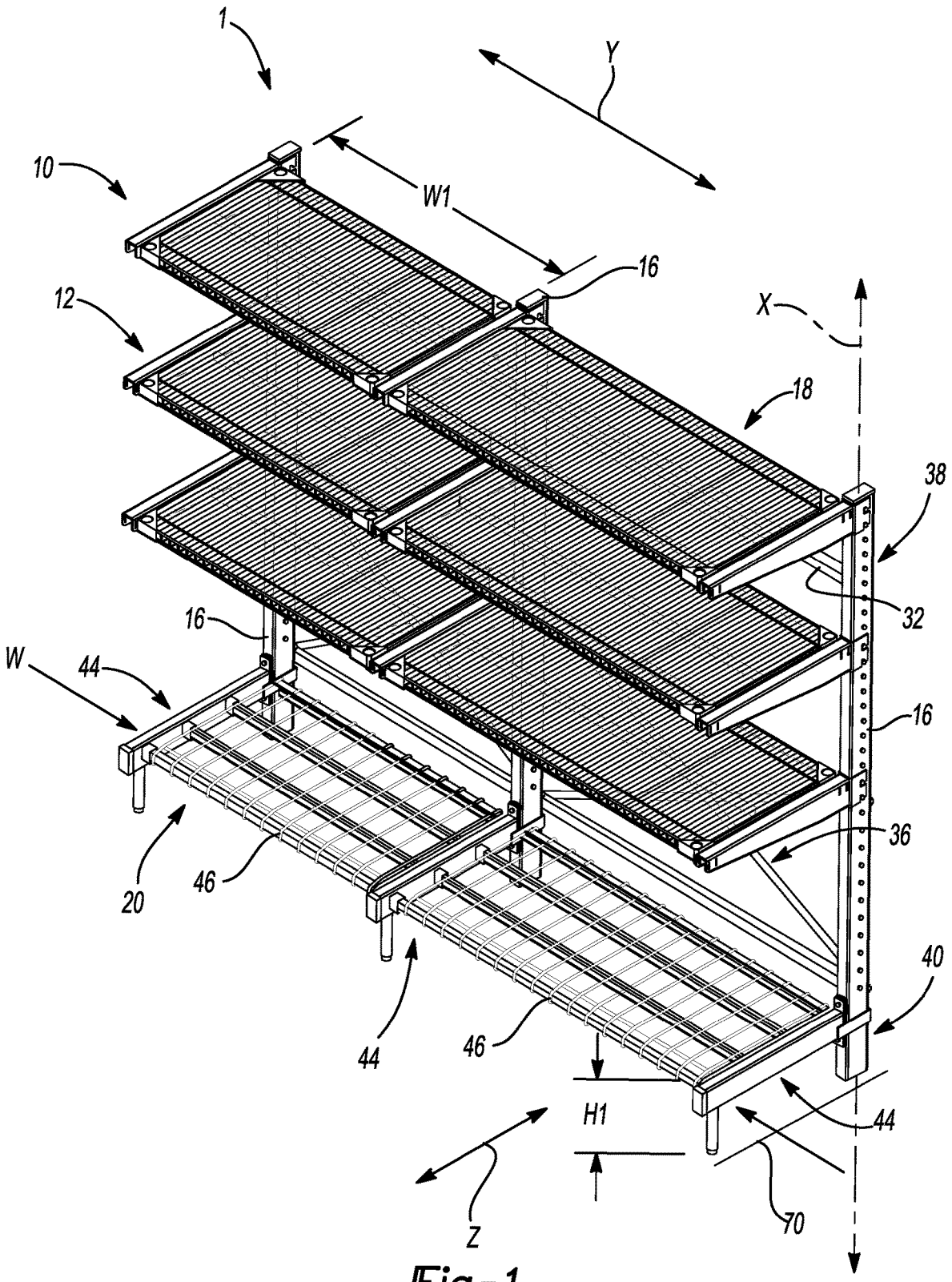
FIG. 1 shows a perspective view of an exemplary cantilever shelving system according to the principles of the present disclosure.
Figure 2:
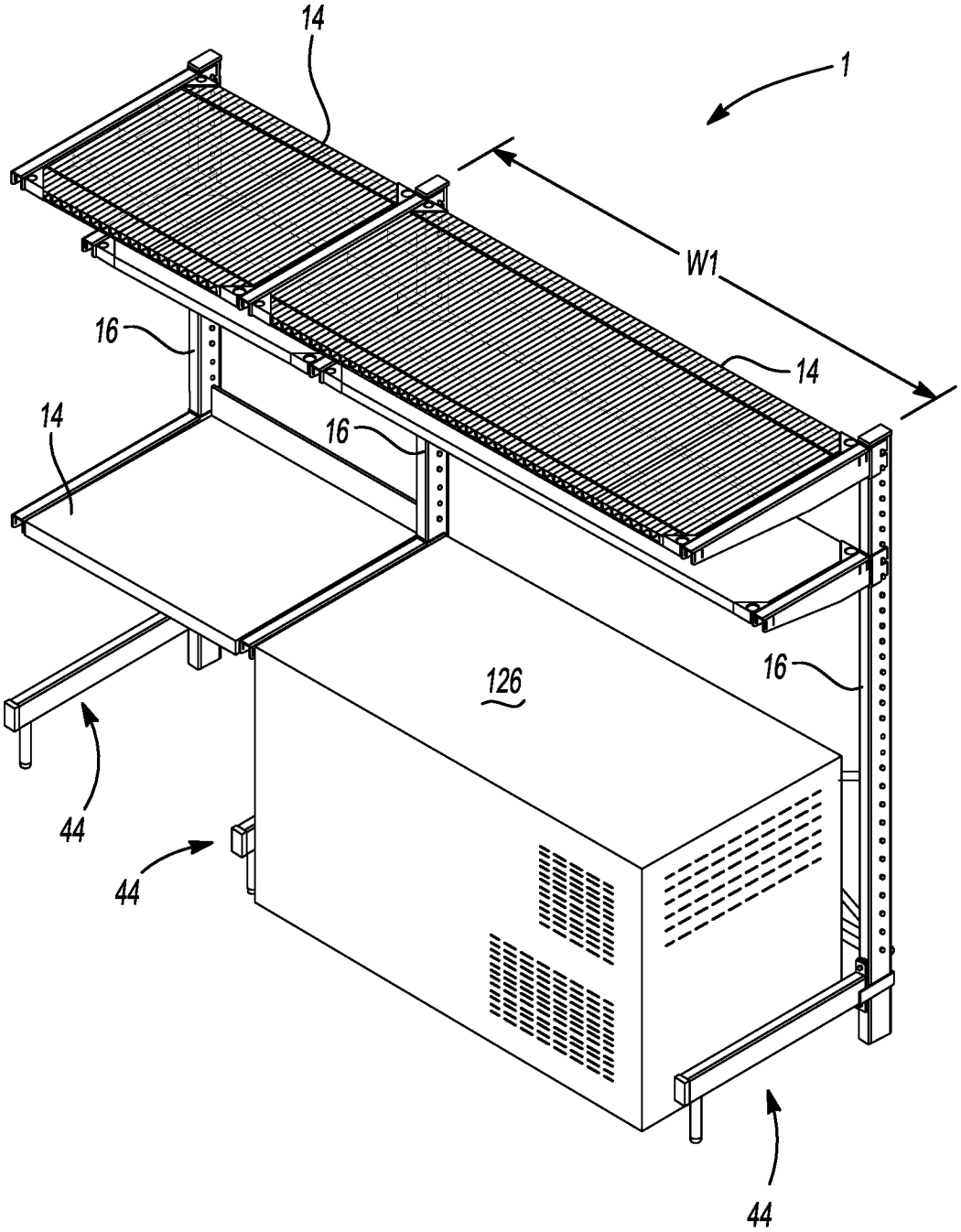
FIG. 2 shows a perspective view of another exemplary cantilever shelving system according to the principles of the present disclosure and including a piece of equipment operably integrated therewith.
Figure 9:
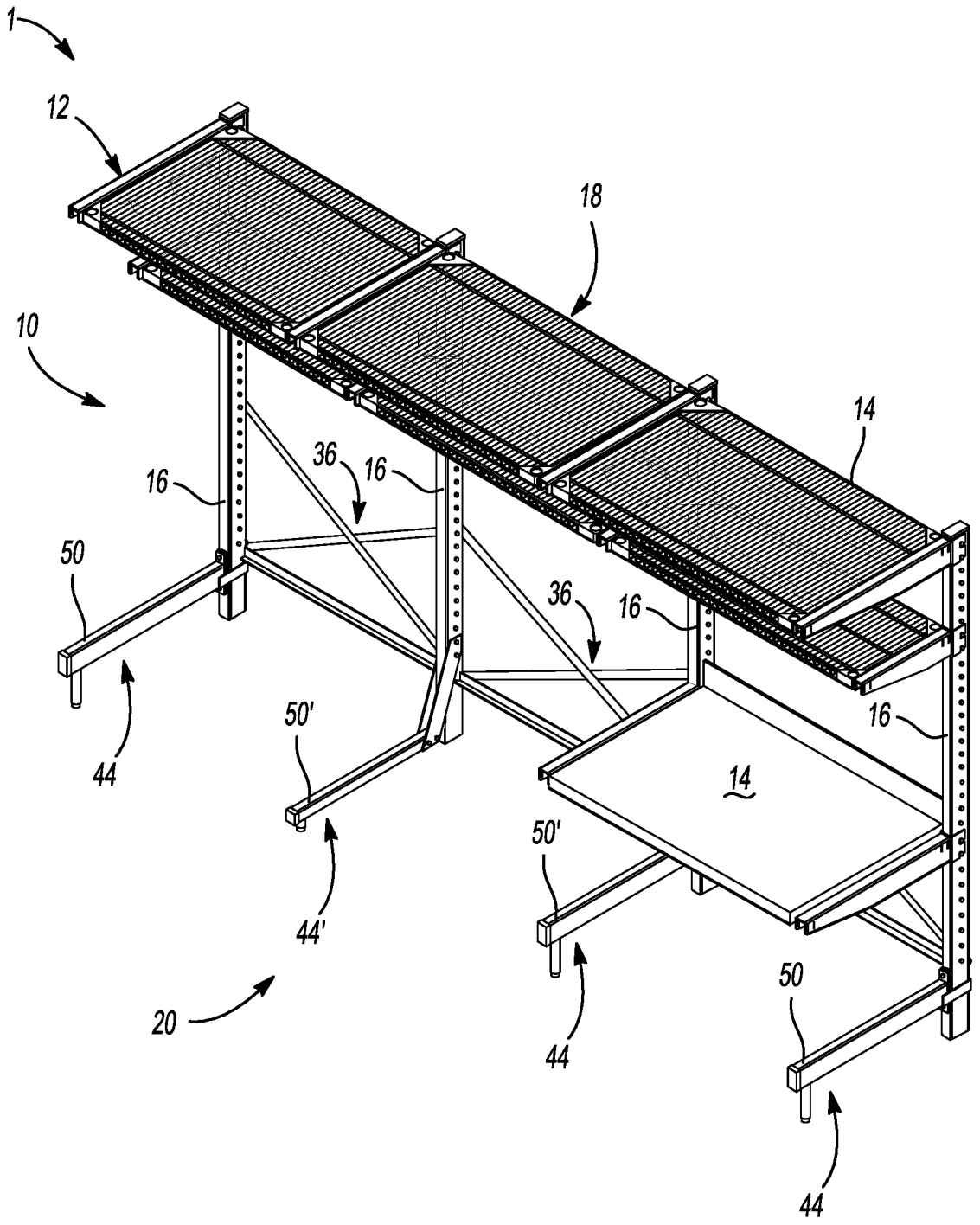
FIG. 9 shows a perspective view of another exemplary cantilever shelving system including a low-profile base support according to the principles of the present disclosure.

Referring to FIGS. 1, 2, and 9, each of the upright support members or vertical support posts 16 can extend vertically along a longitudinal axis X. In one aspect of the present disclosure, the vertical support posts 16 can incorporate a tubular construction or bar extending along the longitudinal axis X and having an exterior surface. In another aspect, a tubular construction can take the form of a hollow, metal tube having a rectangular cross-section having a front side 22, a back side 24, and opposing lateral sides 26. It can be appreciated, however, that other materials and cross-sectional geometries are contemplated within the scope of the present disclosure. Each vertical support post 16 can include an end cap 28 covering each longitudinal end of the vertical support posts 16.

At least two vertical support posts 16 can be positioned from one another in a laterally spaced-apart relationship along a lateral axis Y to establish a width dimension W of the cantilever shelving system 1. As shown in the exemplary embodiment of the cantilever shelving system 1 of the present disclosure of FIG. 1, the cantilever shelving system 1 can include three vertical support posts 16 positioned in a laterally spaced-apart manner and equidistant from one another. However, it can be understood and appreciated, that a cantilever shelving system 1 according to the principles of the present disclosure can be constructed to any desired width dimension W and include any number of vertical support posts 16 (of at least two or more). Further, the vertical support posts 16 can be laterally space-apart equal or unequal distances, depending on the uses or requirements of the cantilever shelving system 1.

Figure 5:
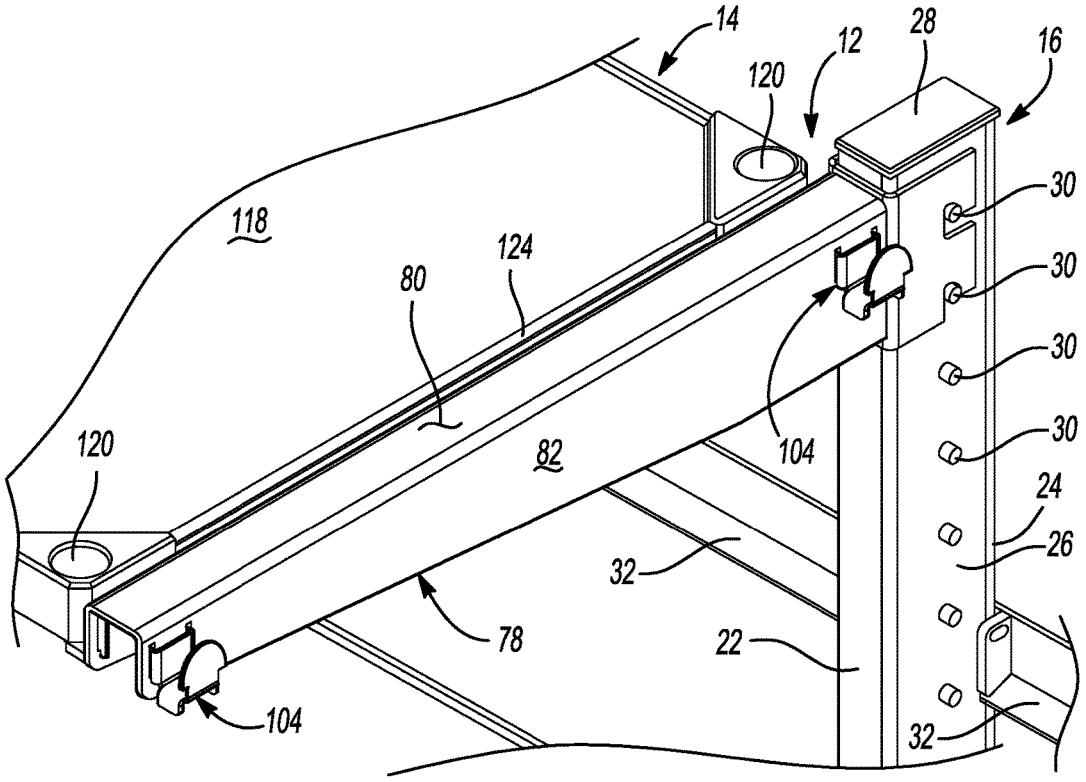
FIG. 5 shows a partial perspective view of the cantilever shelf support structure and load-bearing shelf of the cantilever shelving system of the present disclosure.

As illustrated in FIGS. 1 and 5, each of the vertical support posts 16 can include a plurality of spaced-apart, support members or hanger pins 30 that can protrude or extend outwardly from one or both of the opposing lateral sides 26 of the vertical support posts 16. The hanger pins 30 can be positioned at a plurality of discrete vertical locations in a direction along the longitudinal axis X of the vertical support post 16. The hanger pins 30 can be integrally formed with or fixedly attached to the vertical support posts 16, such as by molding, extruding, forming, mechanical fastening (e.g., threading, interference or deforming), welding, or the like. In one aspect, the hanger pins 30 can exhibit a generally circular, solid cross-section, although cross-sections of other geometries and hollow cross-sections are also contemplated. The hanger pins 30 can protrude from the opposing lateral sides 26 of the vertical support posts 16 so as to be operable to engage the cantilever shelf support structure 12 as will be discussed further herein.

Turning again to FIG. 1, two or more of the vertical support posts 16 can be interconnected to one another by the lateral support structure 18. The lateral support structure 18 can include one or more horizontal crossbars 32. In one aspect of the present disclosure, the horizontal crossbars 32 can have a tubular or bar construction extending along a longitudinal axis and having an exterior surface. In another aspect, a tubular construction can take the form of a hollow, metal tube having a rectangular cross-section having a front side, a back side, and opposing upper and lower sides. It can be appreciated, however, that other materials and cross-sectional geometries are contemplated within the scope of the present disclosure. Each horizontal crossbar 32 can include an end cap (not shown) covering each longitudinal end of the horizontal crossbar 32.

Additionally, or alternatively, the lateral support structure 18 can include one or more cross-braces 36. In one aspect of the present disclosure, the cross-braces 36 can have a stamped, metal construction. However, other materials and configurations are contemplated within the scope of the present disclosure.

The horizontal crossbars 32 can be sized to extend between and/or across some or all of the vertical support posts 16 of the frame structure 10 to laterally interconnect two or more of the vertical support posts 16 together. For example, in one aspect, a horizontal crossbar 32 can be sized to extend between and interconnect two adjacent vertical support posts 16 of the frame structure 10. Alternatively, or in addition, a horizontal crossbar 32 can be sized to extend across and interconnect all of the vertical support posts 16 in the frame structure 10, i.e., across the entire width W of the cantilever shelving system 1. In still another alternative or additional arrangement, a horizontal crossbar 32 can be sized to extend across more than two vertical support posts 16, but less than the entire width W of the shelving system. The horizontal crossbars 32 can be joined or connected to the respective vertical support posts 16 in any of a variety of ways, such as by threaded or deformable fasteners, welding or other similar means.

One or more horizontal crossbars 32 can be positioned at one or more vertical locations along the longitudinal axes X of the vertical support posts 16. In one aspect of the disclosure the cantilever shelving system 1, one or more horizontal crossbars 32 can be included near the upper ends 38 of the vertical support posts 16 and/or a one or more horizontal crossbars 32 can be included near the lower ends 40 of the vertical support posts 16, as shown in FIGS. 1 and 3, for example.

Also as shown in the embodiments of FIGS. 1 and 9, in addition to the one or more horizontal crossbars 32, the lateral support structure of the cantilever shelving system 1 can include one or more cross-braces 36. The cross-braces 36 can include a pair of flat, stamped metal slats or bars 42 arranged in a criss-crossed relationship and fastened or joined to one another at approximately their respective midpoints, such as in a "X" pattern.

The cantilever shelving system 1 can include cross-braces 36 between each of the adjacent pairs of vertical support posts 16, as shown in the figures. As with the horizontal cross bars 32, the cross-braces 36 can be sized to extend between and interconnect two adjacent vertical support posts 16, or some or all of the vertical support posts 16 included in the cantilever shelving system 1. The cross-braces 36 can be joined or connected to the respective vertical support posts 16 in any of a variety of ways, such as by threaded or deformable fasteners, welding or other similar means.

Figure 3:
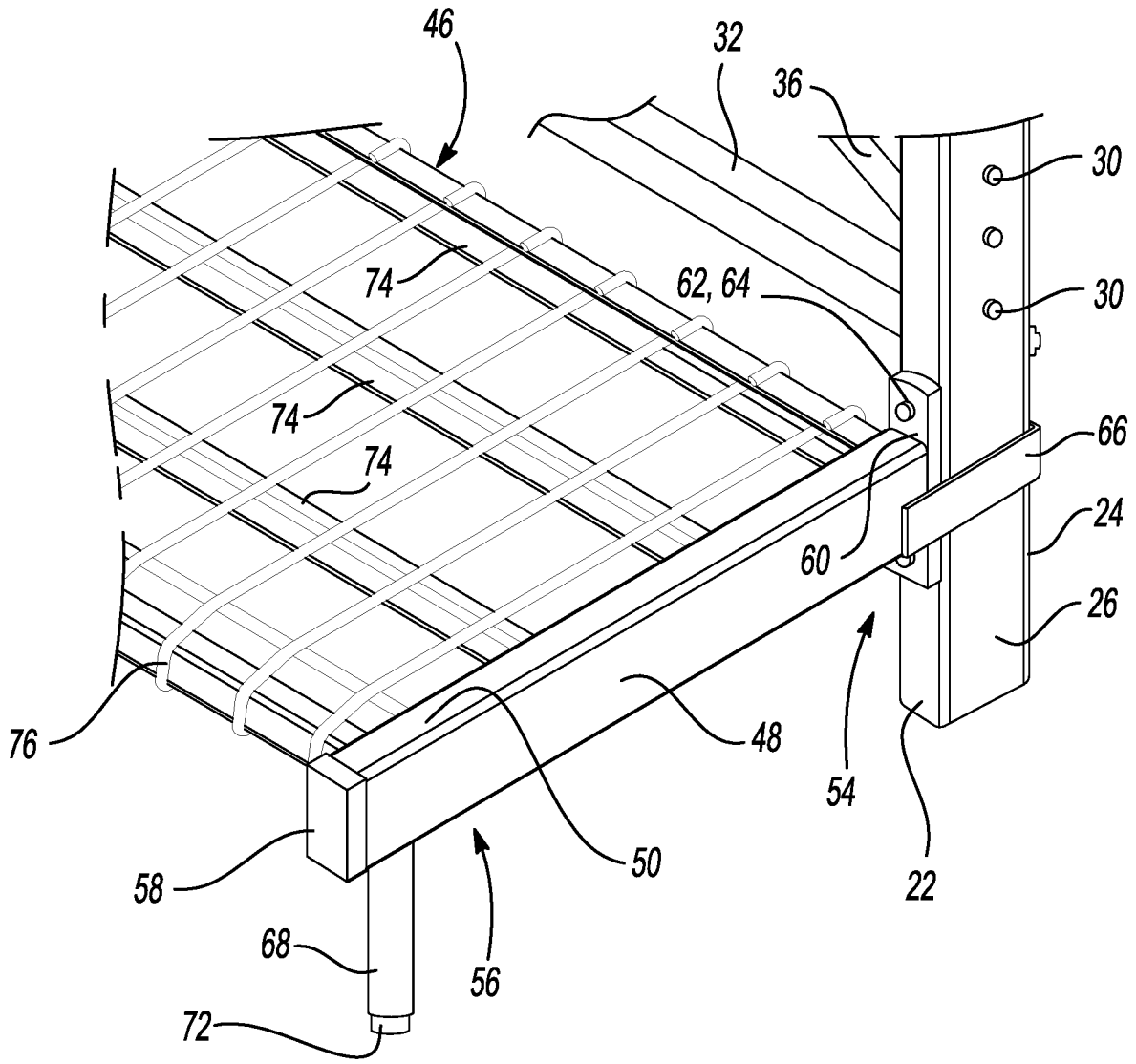
FIG. 3 is an enlarged detail view showing a portion of the base of cantilever shelving system of FIG. 1.
Figure 4:
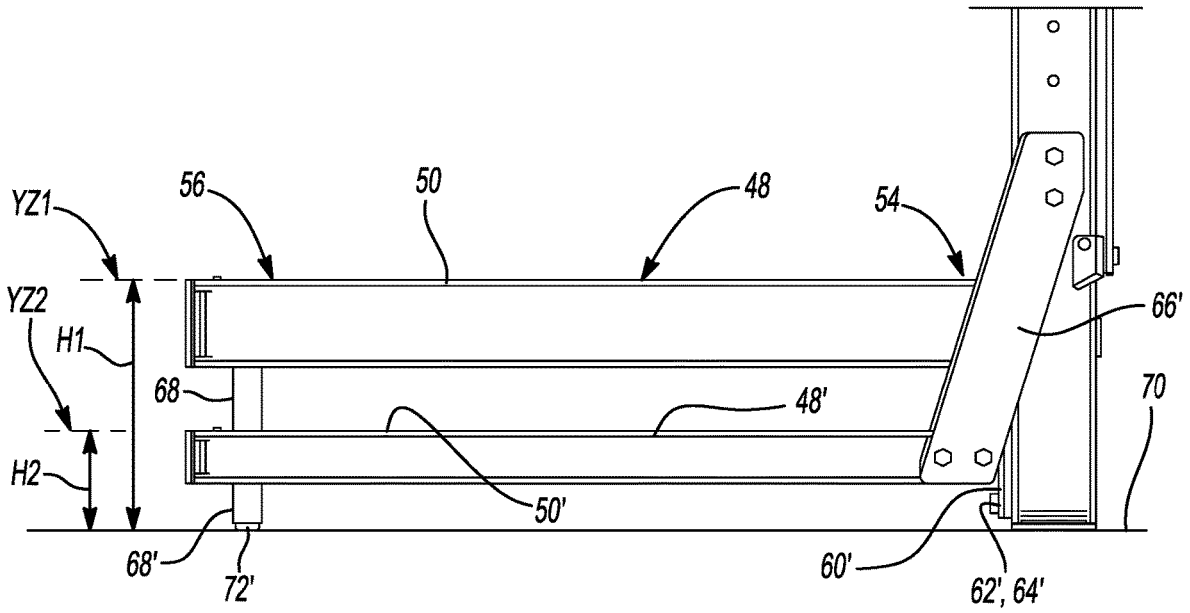
FIG. 4 is a partial side view showing base supports for the cantilever shelving system according to the principles of the present disclosure.

Referring to FIGS. 1, 3 and 4, the frame structure can also include a base 20. The base 20 can include a plurality base supports 44 and one or more base shelves 46.

Preferably, each base support 44 can be associated with and can be attached to a corresponding a vertical support post 16. Therefore, the base 20 of the frame structure 10 can include at least two base supports 44 that can each be associated with the vertical support posts 16 located at opposite lateral ends of the cantilever shelving system 1. Alternatively, every vertical support post 16, however, may not have a corresponding base support 44 attached thereto. For example, if three vertical support posts 16 are included in the frame structure 10, there may not be a base support 44 attached the vertical support post 16 intermediate the opposite lateral ends of the cantilever shelving system 1.

The base support 44 can include a horizontal support leg 48 which can have a tubular or bar construction having an exterior surface. In another aspect, the tubular construction can take the form of a hollow, metal tube having a rectangular cross-section having an upper side 50, a lower side 52, and opposing lateral sides 54. It can be appreciated, however, that other materials and cross-sectional geometries are contemplated within the scope of the present disclosure. In one aspect of the present disclosure, the horizontal support legs 48 of the base supports 44 can all have the same cross-sectional dimensions. In another aspect of the disclosure, a horizontal support leg 48 of at least one base support 44 can have cross-sectional dimension(s) resulting in a different cross-section than the other horizontal support legs 48 of other base supports 44.

The horizontal support leg 48 can extend along a longitudinal axis Z from a proximal end 54 that is adjacent to the corresponding vertical support post 16 to which it attached, toward a distal or terminal end 56. The horizontal support leg 48 can extend forward from the front side 22 of the corresponding vertical support post 16 such that the horizontal support leg 48 can form an angle of approximately ninety degrees with the vertical support post 16. The terminal end 56 of each horizontal support leg 48 can include an end cap 58.

The horizontal support leg 48 can be attached or connected to a respective vertical support post 16 at its proximal end 54, such as by threaded or deformable fasteners, welding or other means. For example, a flange 60 can be integral with or affixed to (e.g., such as by welding) the proximal end 54 of the horizontal support leg 48. The flange 60 can extend along the front side 22 of the vertical support post 16 above and below the horizontal support leg 48. The flange 60 can include mounting apertures 62. The mounting apertures 62 can accommodate fasteners 64 which can engage the vertical support post 16 to fixedly attach the horizontal support leg 48 to the vertical support post 16. In addition, or alternatively, a mounting strap 66 can be fixedly attached to the lateral sides 54 of the horizontal support leg 48 at the proximal end 54 of the horizontal support leg 48 and extend to the lateral side(s) 26 of the vertical support post 16 to also secure the horizontal support leg 48 to the vertical support post 16.

As shown in FIG. 3, the base support 44 can also include a support foot 68 located at or near the distal end 56 of the horizontal support leg 48. The support foot 68 can extend generally vertically downwardly from the horizontal support leg 48. The support foot 68 can be adjustable in length. For example, the support foot 68 can include a leveler, such as a bolt leveler 72.

The base support 44 can be attached to the vertical support post 16 at or near a lower vertical end of the vertical support post 16. Thus, the base support 44 and the lower end of the vertical support post 16 can cooperate to provide a stable foundation for the cantilever shelving system 1 on the support surface 70 (e.g., a floor) upon which the cantilever shelving system 1 is positioned for use. In one aspect of the disclosure, all of the base supports 44 can be positioned and attached to the vertical support posts 16 at the same vertical height H1, such as shown in FIG. 1. In this configuration, the upper sides 50 of all the horizontal support legs 48 can all be situated in a common i.e., first, horizontal plane YZ1. For example, the base supports 44 can be positioned on the vertical support post 16 such that the upper sides 50 of the horizontal support legs 48 are about 6 to 10 inches above the support surface 70.

Figure 11:
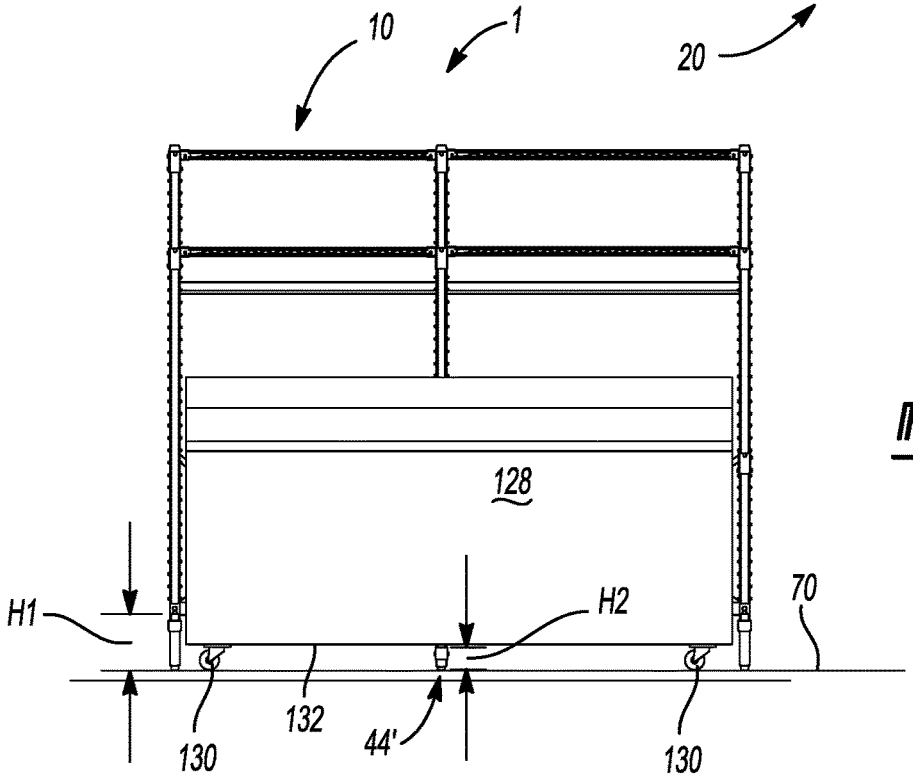
FIG. 11 shows a front view of a cantilever shelving system according to the principles of the present disclosure and including a piece of equipment operably integrated therewith.

In another aspect of the disclosure, as illustrated in FIGS. 4, 9 and 11, at least one base support 44' can be positioned on the vertical support post 16 at a vertical height H2 different than other base supports 44. In such a configuration, the upper side 50' of the horizontal support leg 48' of the one base support 44' lies in a different, i.e., second, horizontal plane YZ2. For example, the second horizontal plane H2 can be vertically lower than the first horizontal plane H1. With reference to FIGS. 4 and 9, an exemplary low-profile base support 44' is shown. The low-profile base support 44' can be positioned on the vertical support post 16 such that the upper side 50' of its horizontal support leg 48' is about 3 to 5 inches above the support surface 70.

Figure 12:
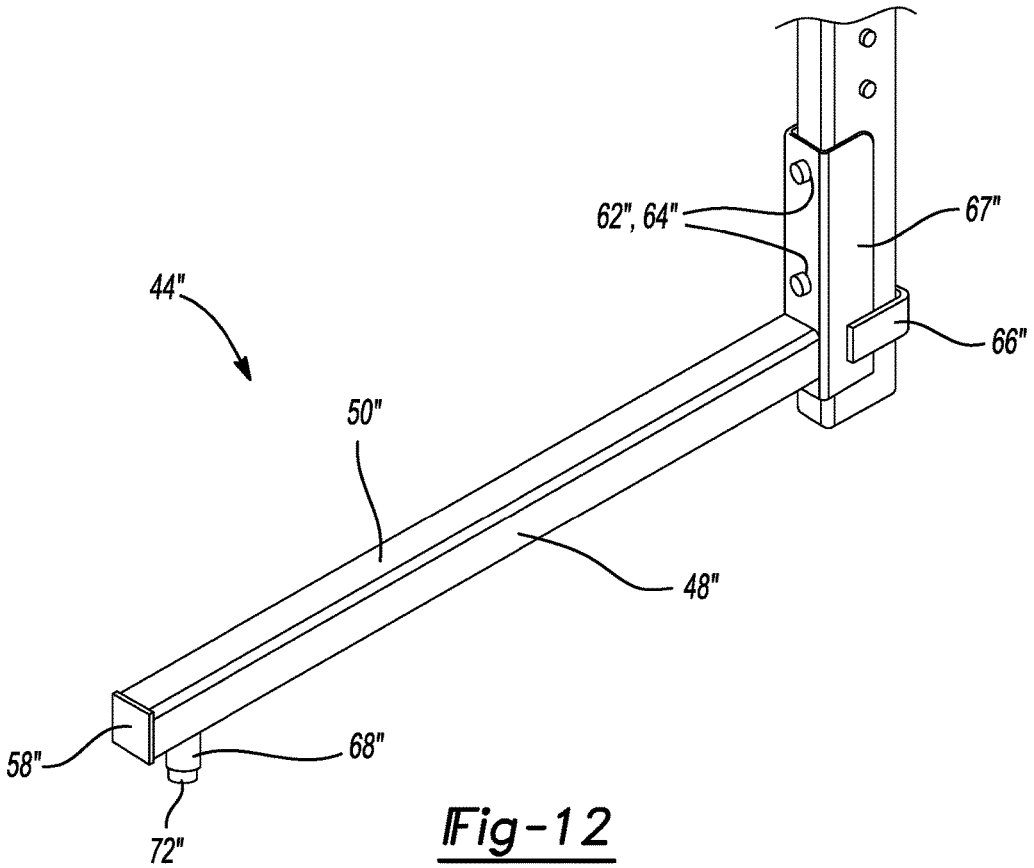
FIG. 12 shows a partial perspective view of an alternative base support for the cantilever shelving system according to the principles of the present disclosure.
Figure 13:
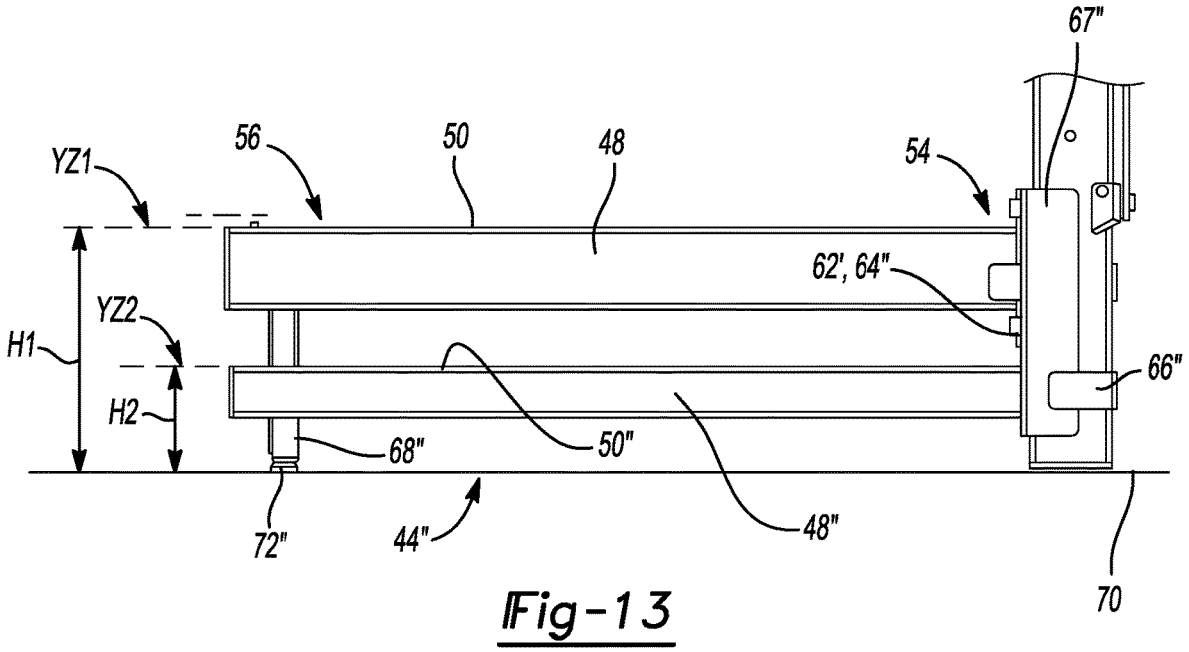
FIG. 13 shows a partial side view of the alternative base support of FIG. 12.
Figure 14:
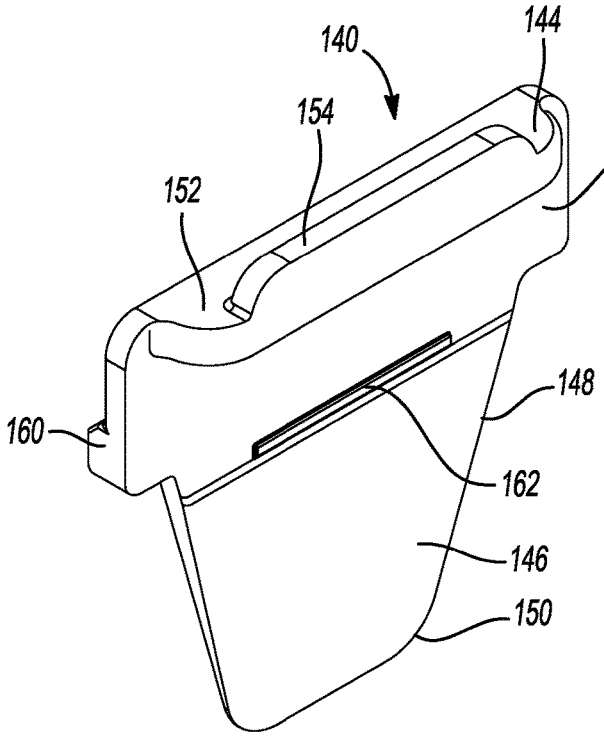
FIG. 14 shows a perspective view of an exemplary wedge member for the cantilever shelving system according to the principles of the present disclosure.
Figure 15:
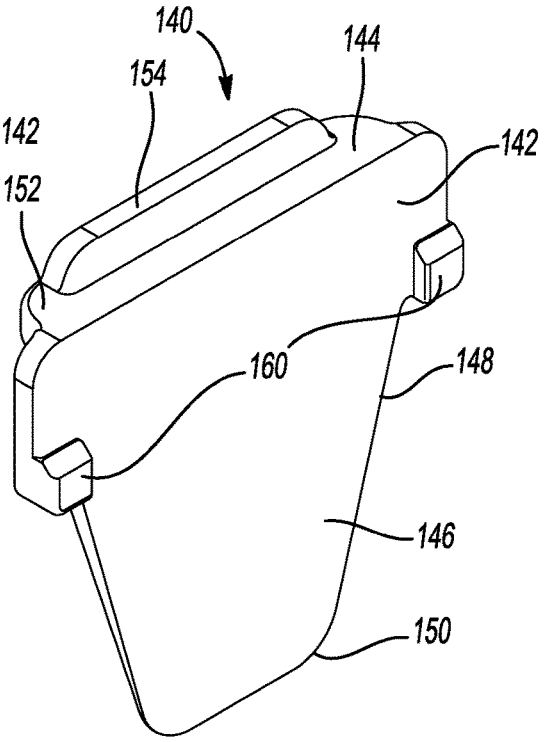
FIG. 15 shows a rear perspective view of the wedge member of FIG. 14.
Figure 16:
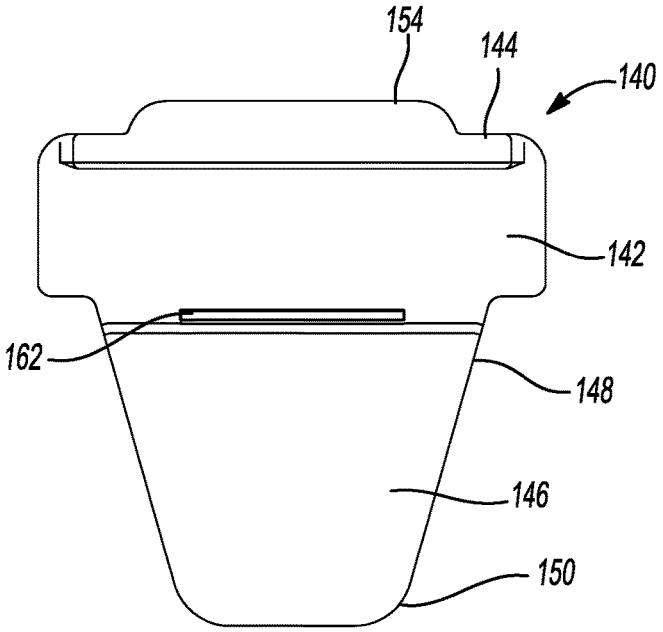
FIG. 16 shows a front view of the wedge member of FIG. 14.
Figure 17:
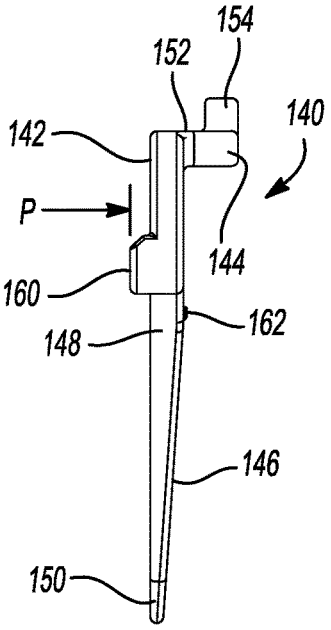
FIG. 17 shows a side view of the wedge member of FIG. 14.

With reference to FIGS. 12 and 13, an alternative embodiment of a base support 44" is shown. As illustrated in FIGS. 12 and 13, the base support 44" includes both a mounting strap 66" and a mounting bracket 67" which can be securely connected to the vertical support post 16 by fasteners 64" passing mounting through apertures 62" in the mounting bracket 67".

One or more base shelves 46 can also be included in the base 20. A base shelf 46 can be positioned on or between adjacent base supports 44. Alternatively, a base shelf 46 can span more than two base supports 44. The base shelf 46 can be fixedly attached to two or more of the base supports 44. In addition to providing a lower storage space for the cantilever shelving system 1, the one or more base shelves 46 can add to the rigidity of the base 20 and the frame structure 10 when securely fastened to the base supports 44.

The base shelf 46 can include a construction of cross members 74 fixedly connected to one another, such as in a rectangular framework. A support surface 76 can be attached to an upper side of the framework. In one aspect, the support surface 76 can include a wire rack. In other aspects, the support surface can include a panel.

Figure 6:
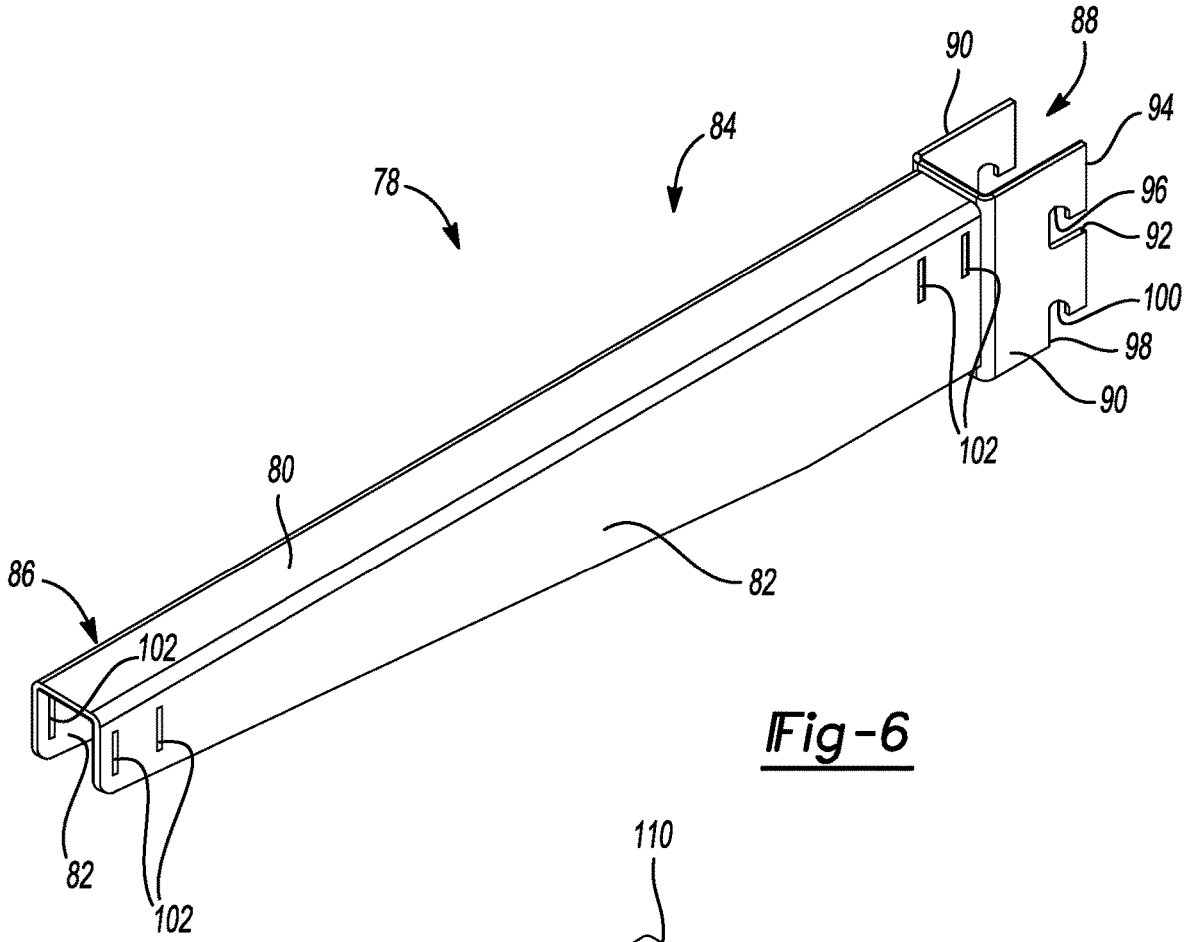
FIG. 6 is a perspective view of an exemplary horizontal cantilever support arm for the cantilever shelving system according to the principles of the present disclosure.
Figure 7:
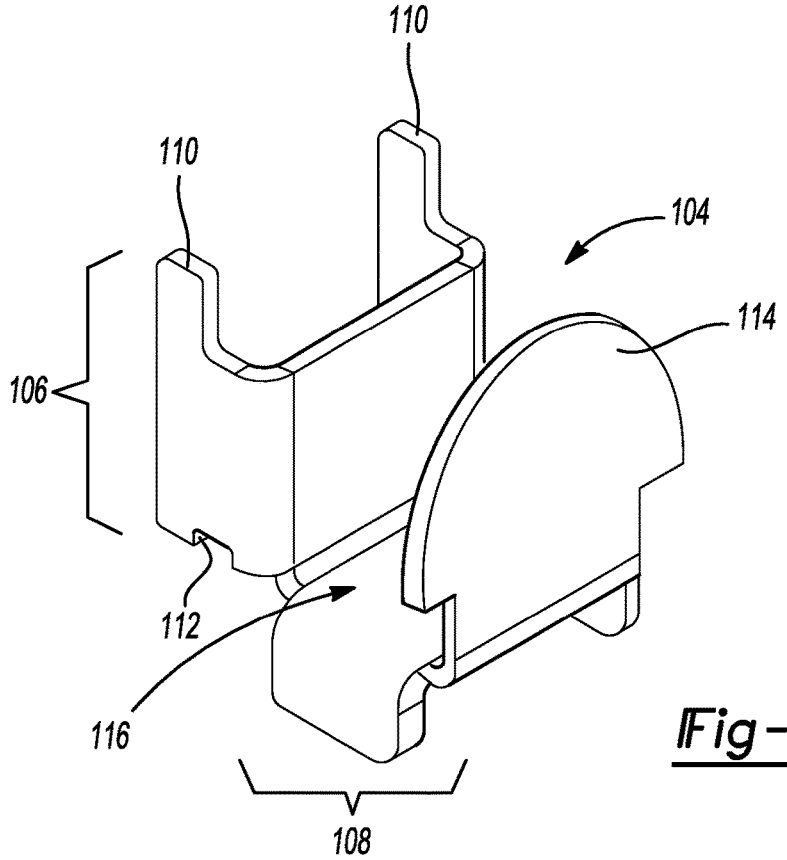
FIG. 7 is a perspective view of a shelf support fitting for the cantilever shelving system according to the principles of the present disclosure.

Referring to FIGS. 5-8, the cantilever shelf support structure 12 of the cantilever shelving system 1 of the present disclosure can be understood. The cantilever shelf support structure 12 can include a plurality of horizontally extending cantilever support arms 78. As best shown in FIG. 6, an exemplary cantilever support arm 78 can comprise an elongated downwardly open channel having a planar upper wall 80 and opposing planar side walls 82. The cantilever support arms 78 can extend from a proximal end 84 to a distal end 86 along a longitudinal axis Z2. The side walls 82 of the cantilever support arms 78 can be tapered, narrowing from the proximal end 84 to the distal end 86.

A mounting flange 88 can be integrally formed with or attached to the proximal end 84 of the cantilever support arm 78. The mounting flange 88 can include opposing side braces 90 that are spaced laterally apart and can be joined by a connecting portion or face 91. The side braces 90 are spaced to enable the mounting flange 88 to closely fit on, over or around the opposing lateral sides 26 of a vertical support post 16. Each of the side braces 90 can include at least a first open slot 92 extending to a rear end 94 of the mounting flange 88. The first open slot 92 can terminate in an offset portion 96. Additionally, each of the side braces 90 can also include a second open slot 98 having a terminal end 100. The second open slot 98 can be offset from the first open slot 92. In one aspect, the second open slot 98 is vertically aligned with and positioned below the offset portion 96 of the first open slot 92. The first and second open slots 92, 98 can be sized to accommodate and engage with the hanger pins 30 on the vertical support posts 16.

At least two elongated apertures or narrow slots 102 can be included in each of the side walls 82 of the cantilever support arm 78. At least one narrow slot 102 can be included near the proximal end 84 of the cantilever support arm 78, and at least one narrow slot 102 near the distal end 86 of the cantilever support arm 78. In one aspect, a pair of vertically extending and generally parallel narrow slots 102 can be included near each of the proximal and distal ends 84, 86 of each of the side walls 82 of the cantilever support arm 78, as shown in FIG. 6.

The cantilever shelf support structure 12 can also include a plurality of shelf support fittings 104. The shelf support fittings 104 can be adapted to attach to the cantilever support arms 78 by way of the narrow slots 102 in the side walls 82 of the cantilever support arms 78 as best seen in FIG. 5. Each shelf support fitting 104 can include a mounting portion 106 and a support portion 108. The mounting portion 106 can include at least one mounting tab 110 at an upper end and at least one lock notch 112 at a lower end. The mounting tab 110 can engage an inside surface of the side wall 82 of the cantilever support arm 78 above the narrow slot 102 and the lock notch 112 can engage a lower end of the narrow slot 102 when the shelf support fitting 104 is attached to the cantilever support arm 78.

The support portion 108 of the shelf support fitting 104 can be positioned adjacent to and offset from a lower end of the mounting portion 106. The support portion 108 can include an upward projection 114 at an outer end of the support portion 108 that is offset from the mounting portion 106 by a horizontal base 116. The projection 114 can be adapted to engage a loadbearing shelf 14.

FIGS. 1, 2, 5 and 8 show exemplary load bearing shelves 14 for use in the cantilever shelving system 1 of the present disclosure. The shelves 14 can be generally rectangular in shape and provide a load-bearing upper support structure or surface 118. The shelves 14 can include, for example, wire shelves and panel shelves well-known in the art having standard length dimensions, e.g., 24, 30, 36, 42, 48, 60 and 72 inches. Each shelf 14 can include a shelf mounting collar 120 at or near each of the four corners of the shelf 14. The shelf mounting collar 120 can be a generally hollow cylinder having an open lower end and a closed upper end. The shelf mounting collar 120 can engage the projection 114 and base 116 of the support portion 108 of the shelf support fitting 104 to attach the shelf 14 to the cantilever support arm 78. Suitable load-bearing shelves 14 that can be used in the cantilever shelving system 1 of the present disclosure are available from InterMetro Industries Corporation, the assignee of the present application, under the Super Erecta Shelf® product line.

Figure 8:
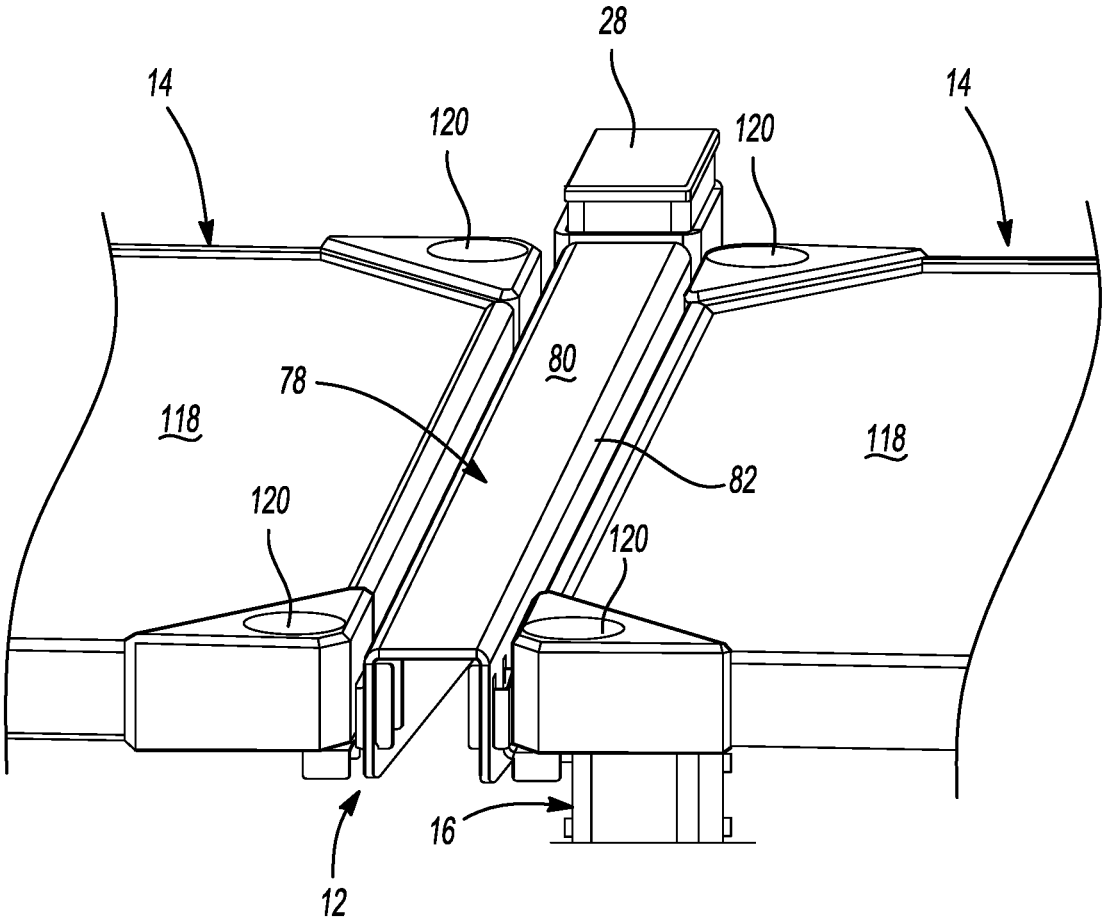
FIG. 8 shows a partial perspective view of a portion of two adjacent load-bearing shelves of the cantilever shelving system of the present disclosure.

The cantilever support arms 78 can be attached to the vertical support posts 16, as best illustrated in FIGS. 5 and 8. The mounting flange 88 of the cantilever support arm 78 can slide over lateral sides 26 of the vertical support post 16. The mounting flange 88 can slide horizontally past the hanger pins 30 which can then engage the first and second open slots 92, 98 in the braces 90 of the mounting flange 88. When the proximal end 84 of the cantilever support arm 78 abuts the front side 22 of the vertical support post 16 (e.g., at the connecting face 91 of the mounting flange 88), the cantilever support arm 78 and mounting flange 88 can slide vertically downwardly so that the hanger pins 30 can simultaneously engage or abut against the offset portion 96 of the first open slot 92 and the terminal end 100 of the second open slot 98. Thus, the cantilever support arm 78 is attached to the vertical support post 16 in a cantilevered manner.

A load-bearing shelf 14 as previously described can then be installed between two adjacent cantilever support arms 78. The shelf 14 can be lowered between the cantilever support arms 78 so that the shelf mounting collars 120 engage corresponding shelf support fittings 104 attached to the cantilever support arms 78. Thus, as illustrated in FIGS. 5 and 8, in the cantilever shelving system 1 of the present disclosure, the shelf 14 can be located adjacent to the cantilever support arm 78 and the end 124 of the shelf 14 does not overlap with the front side 22 of the vertical support post 16. As best shown in FIG. 8, the upper support surfaces 118 of the adjacent load-bearing shelves 14 can be coplanar. Moreover, the upper wall 80 of the cantilever support arm 78 is also coplanar with the support surfaces 118 of the adjacent shelves 14. Therefore, the cantilever support arm 78 of the cantilever shelving system 1 of the present disclosure can provide a continuous and smooth transition surface between adjacent shelves 14.

Referring again to FIGS. 1, 2 and 8, the cantilever shelving system 1 of the present disclosure, and particularly arrangement of the cantilever shelf supporting structure 12, can enable the width dimension W1 between adjacent portions of the frame structure 10, including the vertical support posts 16 and base supports 44, to be at least the same value as the length dimension of the shelf 14. For example, when a 36 inch shelf is installed in the cantilever shelving system 1 of the present disclosure, the width dimension W1 between the adjacent portions of the frame structure 10 can be at least 36 inches. This feature is unlike prior known cantilever shelving systems. In prior known cantilever shelving systems, the width dimension between adjacent portions of the frame supporting a shelf is less than the length dimension of the shelf. This is because prior known supporting structure for mounting the shelf to the frame is located directly beneath the shelf or that structure forms part of the shelf, itself.

It can be appreciated that the cantilever shelving system 1 of the present disclosure provides significant advantages for adapting and/or modifying the cantilever shelving system 1 to accommodate various user requirements over known shelf systems. In addition, the cantilever shelving system 1 of the present disclosure can easily be operably integrated with standard industrial and/or commercial machinery or equipment with which the cantilever shelving system 1 may be associated during use.

Figure 10:
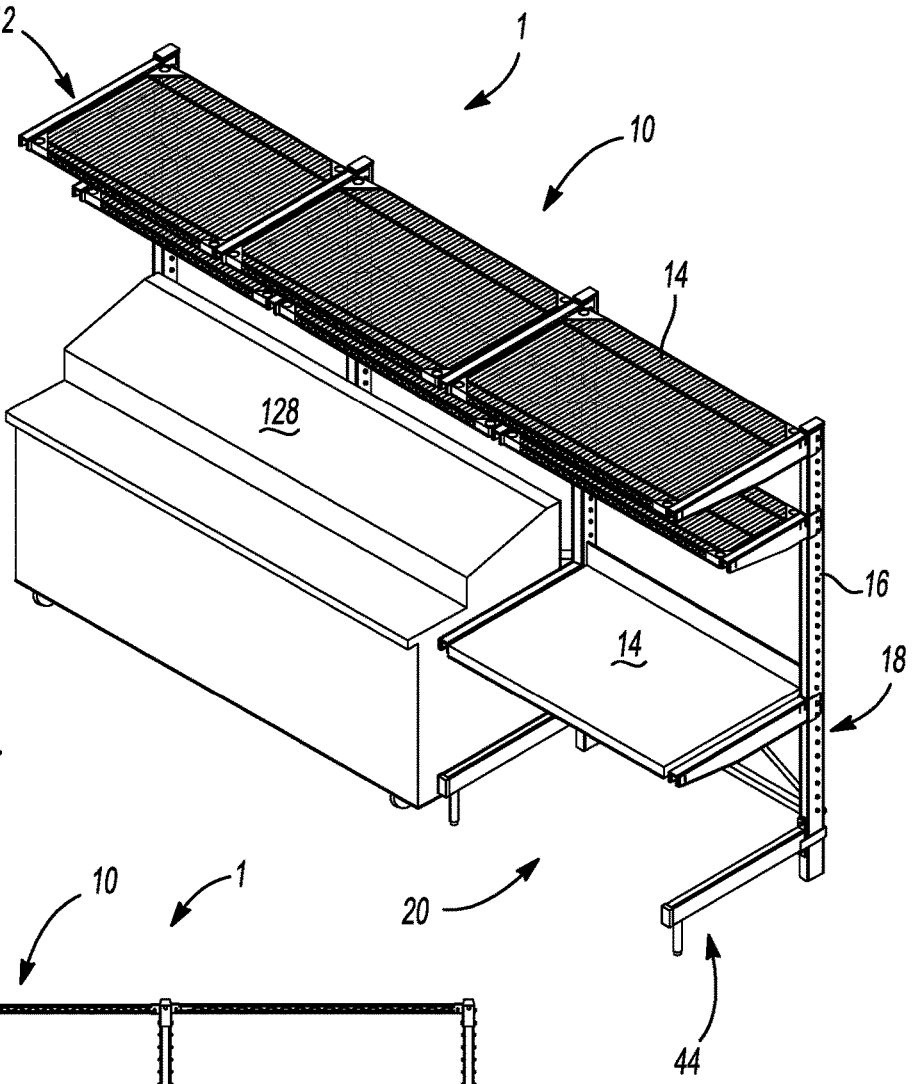
FIG. 10 shows a perspective view of the cantilever shelving system of FIG. 9 and including a piece of equipment operably integrated therewith.

For example, common commercial kitchen equipment 126 can have standard dimensions corresponding to the dimensions of known standard-sized shelves. In FIG. 2, a standard piece of kitchen equipment 126 is shown having a standard width dimension. The equipment 126 can be operably integrated with the cantilever shelving system 1 and located in the space created in the frame structure 10, between two of the vertical support posts 16 and corresponding base supports 44 and beneath the standard length shelves 14. As another example, a standard-wide piece of kitchen equipment 128 can be operably integrated with a cantilever shelving system 1 including a low-profile base support 44', as shown in FIGS. 9-11. The equipment 128 can, for example be moveable on casters 130 which can raise the base 132 of the equipment 128 about four to six inches above the floor 70. The base 132 of the equipment 128 can pass over the low-profile base support 44' and can be located in the space created in the frame structure 10 between the vertical support posts 16 and corresponding base supports 44 and beneath the standard length shelves 14.

Additionally, it can also be appreciated from FIGS. 1, 2, and 9, that the cantilever shelving system 1 can incorporate a plurality of shelves 14, and the shelves 14 can have a plurality of different length and width dimensions. Further, it can be appreciated that the cantilever shelving system 1 can be constructed and/or modified (e.g., widened or narrowed) simply and easily by adding or removing portions of the frame structure 10 (e.g., vertical support posts 16 and base supports 44, 44').

Referring now to FIGS. 14-19, the cantilever shelving system 1 can include a locking wedge or wedge member 140. As further described below, the wedge member 140 can be configured to fit between the shelf support fitting 104 and the side wall 82 of the cantilever support arm 78. The wedge member 140 can be used to occupy any space or gap that may exist between the shelf support fitting 104 and the side wall 82 In this manner, the wedge member 140 secures and/or limits play or movement of the shelf support fitting 104 relative to the side wall 82. When assembled, the wedge member 140 secures or locks the shelf support fitting 104 in position relative to the cantilever support arm 78 in the cantilever shelving system 1. When the wedge member 140 is removed from the shelving system 1, the shelf support fitting 104 can also be easily removed from the cantilever support arm 78.

Figure 18:
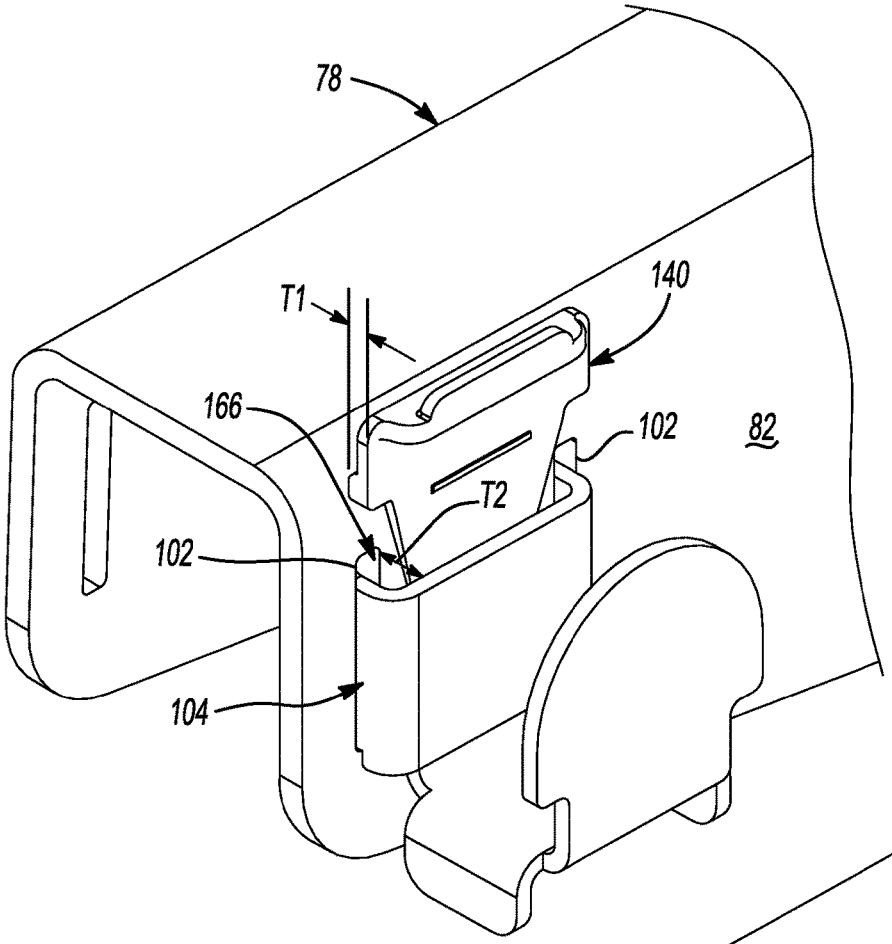
FIG. 18 shows a perspective view of the wedge member of FIG. 14 being installed between a shelf support fitting and a cantilever support arm.
Figure 19:
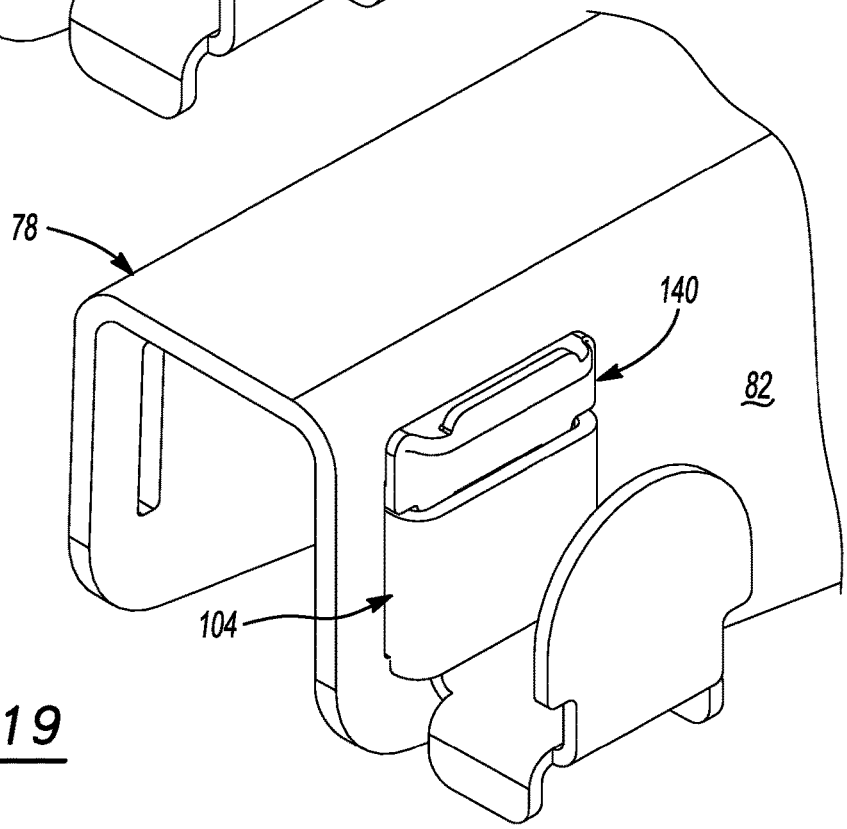
FIG. 19 shows a perspective view of the wedge member of FIG. 14 in the installed position.

As shown in FIGS. 14-17, the wedge member 140 can include a body portion 142, an offset portion 144 and a leading portion 146. The body portion 142 can be positioned vertically between the offset portion 144 and the leading portion 146. In the example shown, the leading portion 146 is linearly aligned with the body portion 142. The leading portion 146 projects downwardly from the body portion 142 and has a tapered or wedge-shaped profile. As such, a thickness of the leading portion 146 is greater at a proximal end 148 than at a terminating end 150. The tapered profile of the leading portion 146 can assist in guiding the wedge member 140 into a seated position between the shelf support fitting 104 and the side wall 82 of the cantilever support arm 78 as shown in FIGS. 18 and 19.

The leading portion 146 of the wedge member 140 can also have a tapered shape in the transverse direction. A width of the leading portion 146 at the proximal end 148 can be greater than a width of the leading portion 146 at the distal end 150. In other examples, the leading portion 146 can have other suitable shapes and/or profiles.

The offset portion 144 can be positioned on an opposite side of the body portion 142 than the leading portion 146. The offset portion 144 can project away from the body portion 142 and such that the offset portion 144 is not coplanar with either the body portion 142 or the leading portion 146. In the example shown, the offset portion 144 includes an extending wall 152 and an upright tab 154. The extending wall 152 can project substantially perpendicularly away from the body portion 142 and the upright tab 154 can project substantially perpendicularly away from the extending wall 152 in a direction away from the body portion 142 and/or the leading portion 146. In this configuration, the upright tab 154 can be positioned substantially parallel to the body portion 142 and/or the leading portion 146 while being offset from the body portion 142 and/or the leading portion 146.

As further shown in the figures, the wedge member 140 can include one or more pads 160. The example shown includes two pads 160 positioned at opposite sides of the wedge member 140. The pads 160 can be rectangular in shape and can project outward and away from the body portion 142 in a direction opposite to the extending wall 152. The pads 160 can project any suitably distance away from the body portion 142. In the example shown, the pads 160 project away from the body portion 142 by a distance P. The distance P can be approximately the same as the thickness of the body portion 142. In other examples, the distance P can be approximately one-half the thickness of the body portion 142. In still other examples, the distance P can be any suitable distance to permit the wedge member 140 to be retained in position.

As further shown, the pads 160 can include rounded, tapered or other shapes at their edges. In other examples, the pads can have circular, oval, triangular or other suitable profiles or shapes.

The wedge member 140 can also include a rib 162. The rib 162 can project outward from the wedge member 140 on a side of the wedge member 140 opposite to the pads 160. The rib 162 can be oriented at or near the region of the wedge member 140 where the body portion 142 meets the leading portion 146. The rib 162 can be a horizontal projection that extends outward from the wedge member 140 along more than one-half of the width of the wedge member 140. In other examples, the rib 162 can have other shapes or sizes. The rib 162 can also be configured as two or more projections that project outward from the wedge member 140.

In the example shown, the wedge member 140 is a unitary member formed to have the shape as shown. The wedge member 140 can be formed of any suitable elastomeric material such as a suitable plastic, synthetic or natural rubber, or the like.

As shown in FIGS. 18 and 19, the wedge member 140 is configured to fit between the shelf support fitting 104 and the side wall 82 of the cantilever support arm 78. A thickness T1 of the wedge member measured between the outer surface of the pads 160 to the opposite outer surface of the body portion 142 can be greater than a distance T2 measured between the side wall 82 and the inner surface of the shelf support fitting 104. In this example configuration, the wedge member 140 can have an interference fit with a pocket 166 formed by the side wall 82 and the shelf support fitting 104. Since the wedge member 140 can contact both the side wall 82 and the shelf support fitting 104 in the pocket 166, the shelf support fitting 104 can be limited from moving relative to the cantilever support arm 78 and be maintained in position.

Figure 20:
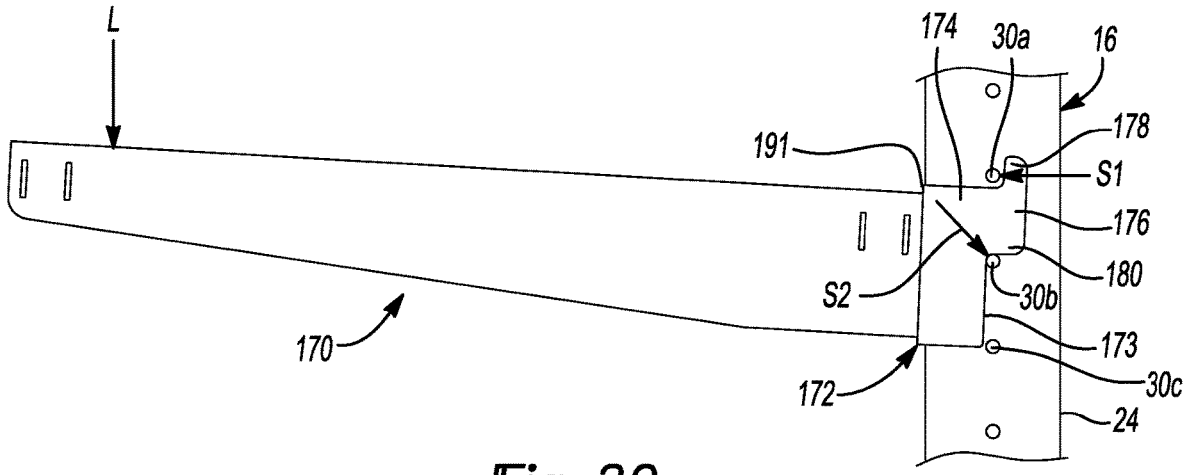
FIG. 20 shows a side view of an alternative horizontal cantilever support arm and mounting flange according to the principles of the present disclosure in an installed position on a support member.

The pads 160 can be positioned and sized such that the pads 160 interface with the narrow slots 102 of the cantilever support arm 78. The pads 160 can be positioned such that the pads 160 are longitudinally aligned with the narrow slots 102. The pads 160 can be positioned over a corresponding narrow slot 102. At least a portion of the pad 160 can fit into a corresponding narrow slot 102 when the wedge member 140 is fully seated into the pocket 166 as shown in FIG. 20. When the pads 160 are positioned at the narrow slots 102, the interface between the pad 160 and the slot 102 can assist in retaining the wedge member 140 in the pocket 166.

As can be appreciated, the wedge member 140 can also prevent debris, food particles or other contaminants from entering the pocket 166 or from becoming otherwise deposited between the cantilever support arm 78 and the shelf support fitting 104. The offset portion 144 and/or tab 154 can be used to easily remove (and reinstall) the wedge member 140 from the cantilever shelving system 1 so that the system can be cleaned disassembled and re-assembled.

Figure 21:
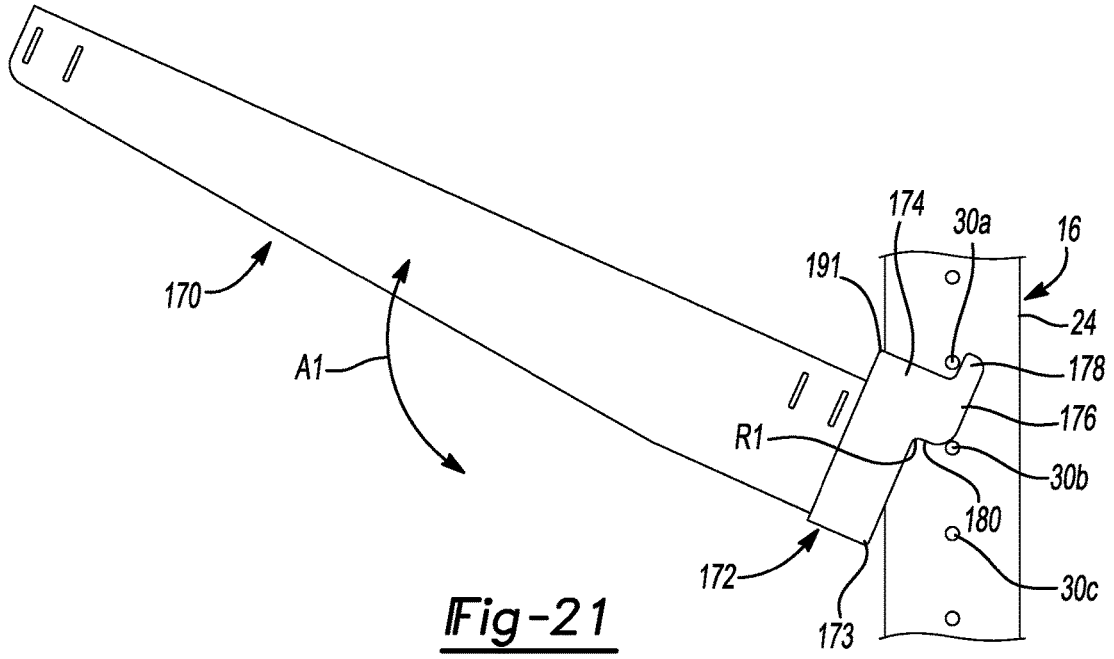
FIG. 21 shows a side view of the horizontal cantilever support arm and mounting flange of FIG. 20 being rotated into the installed position on a support member.

Turning now to FIGS. 20 and 21, another example cantilever support arm 170 is shown. In this example, the cantilever support arm 170 can have many of the same characteristics of the cantilever support arm 78 previously described. In this example, however, the cantilever support arm 170 has a mounting flange 172 that is different from the mounting flange 88 previously described. The mounting flange 172 has a side brace 174 including a finger portion 176 and a rearward-facing edge 173. As can be appreciated, the mounting flange 172 can include a second side brace 174 (not shown) that is positioned symmetrically opposite to the side brace 174 shown that is configured to interface with an opposite side of the vertical support post 16.

As shown, the side brace 174 can be positioned adjacent to a lateral side 26 of the vertical support post 16. The vertical support post 16 can include a plurality of hanger pins 30 that project outward from the vertical support post 16. In the example shown, the finger portion 176 can interface with adjacent hanger pins 30*a* and 30*b*. Installation and removal of the cantilever support arm 170 can be understood from FIG. 21. With the cantilever support arm 170 positioned at slight upward angle (from horizontal), an upper end 178 of the finger portion 176 can be inserted between two adjacent hanger pins 30*a* and 30*b*. The cantilever support arm 170 can then be rotated in a counterclockwise direction (arrow A1) to direct the upper end 178 of the finger portion 176 to seat the finger portion 176 in an installed position as shown in FIG. 20. In the installed position, the upper end 178 can be positioned adjacent to the hanger pin 30*a* on a side of the hanger pin 30*a* closer to the back side 24 of the support post 16 (i.e., a rearward side). A lower bearing edge 180 of the finger portion 176 is adjacent to the rearward-facing edge 173 of the side brace 174 and a radius R1 is included therebetween. In an installed position, the radius R1 can be adjacent to the hanger pin 30*b* such that the bearing edge 180 is positioned against a top side of the hanger pin 30*b* and the rearward-facing edge 173 is positioned against a front side of the hanger pin 30*b*. Additionally, the connecting face 191 of the mounting flange 172 can simultaneously bear against the front side 22 of the post 16. In such an installed position, mounting flange 172 engages the vertical support post 16 to position the cantilever support arm 170 relative to the vertical support post 16.

As can be appreciated, removal of the cantilever support arm 170 can be achieved in a manner reverse to that described above.

As shown in FIG. 20, the finger portion 176 can transfer the loads that may be exerted on the cantilever support arm 170 to the vertical support post 16. When a load is exerted on the cantilever support arm 170, at least a portion can be transferred to one or more of the hanger pins 30*a* and/or 30*b*. In this example, a portion of the load L is transferred to the hanger pin 30*a* as force S1. Additionally, at least a portion of the load L can also be transferred to the adjacent hanger pin 30*b* as force S2. Additionally or alternatively, at least a portion of the load L may be transferred to the front side 22 of the post 16 across the connecting face 191 of the mounting flange 172.

As shown in this example, the mounting flange 172 stops at or near the vertical position of the hanger pin 30*c*. In other examples, the mounting flange 172 can be configured so that the mounting flange has other shapes or lengths such that it extends to other positions relative to the hanger pin 30*c*. For example, the mounting flange 172 can be positioned relative to the cantilever support arm 78 such that the cantilever support arm 78 (or a portion thereof) is oriented at an oblique angle relative to the support post 16. In such an alternate orientation, the cantilever support arms 78 can support a shelf at the oblique angle relative to the support posts 16 rather than in an orthogonal horizontal relationship as shown.

Figure 22:
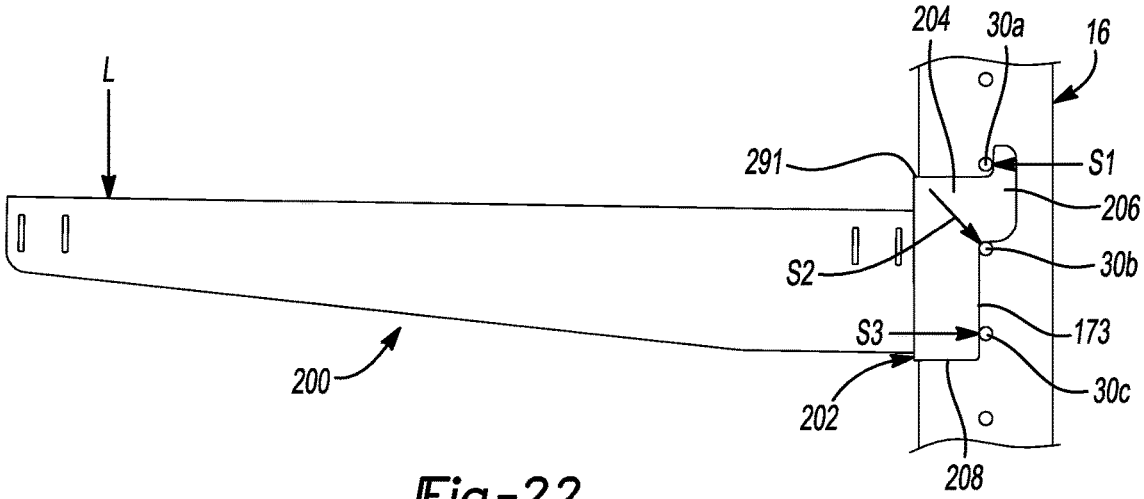
FIG. 22 shows still another alternative horizontal cantilever support arm and mounting flange similar to that of FIG. 21 in an installed position on a support member according to the principles of the present disclosure.

Another example cantilever support arm 200 is shown in FIG. 22. In this example, the cantilever support arm 200 includes a mounting flange 202 that is similar to the mounting flange 172 previously described. The mounting flange 202 includes a finger portion 206 that interfaces with the hanger pins 30*a* and 30*b* as previously described. In this example, however, the mounting flange 202 includes a side brace 204 that extends further downward relative to the hanger pins 30*a*, 30*b*, and 30*c*. A base edge 208 of the mounting flange 202 is positioned vertically lower than the hanger pin 30*c*. With this configuration, a load L that may be exerted on the cantilever support arm 200 may be transferred to a third hanger pin 30*c* as force S3, in addition to the hanger pins 30*a* (force S1) and 30*b* (force S2). Additionally or alternatively, at least a portion of the load L may be transferred to the front side 22 of the post 16 across the connecting face 291 of the mounting flange 202.

Figure 23:
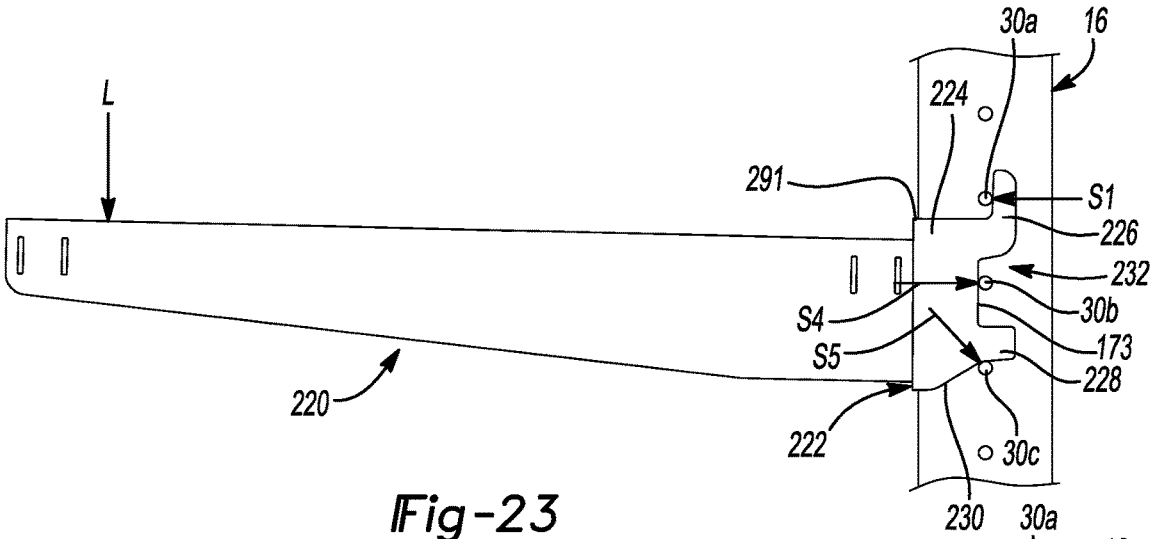
FIG. 23 shows a side view of yet another alternative horizontal cantilever support arm and mounting flange in an installed position on a support member according to the principles of the present disclosure.

Still another example cantilever support arm 220 is shown in FIG. 23. In this example, the cantilever support arm 220 includes a mounting flange 222. The mounting flange 222 can include one or more of the previously described features. As shown, the mounting flange 222 can include a first finger portion 226. The first finger portion 226 can be installed between the hanger pin 30*a* and 30*b*. The mounting flange 222 can also include a second finger portion 228 including an edge 230. In the installed position, the second finger portion 228 can be positioned at a vertical position between the hanger pin 30*b* and the hanger pin 30*c*. The edge 230 contacts or rests on the hanger pin 30*c* when the cantilever support arm 220 is in the installed position. With this configuration, the mounting flange 222 includes a gap 232 between the first finger portion 226 and the second finger portion 228. In the installed position, the hanger pin 30*b* is located in the gap 232. With this configuration, a load L that may be exerted on the cantilever support arm 220 can be transferred to the first hanger pin 30*a* as force S1, the second hanger pin 30*b* as force S4 (and/or to the front side 22 of the post 16 across the connecting face 291 of the mounting flange 224), and the third hanger pin 30*c* as force S5.

Figure 24:
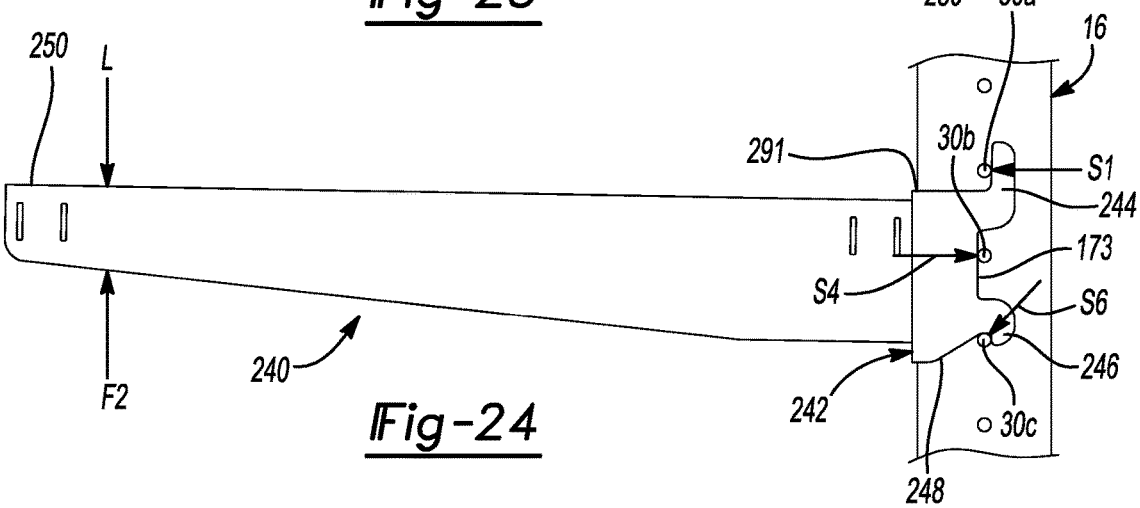
FIG. 24 shows a side view of another alternative horizontal cantilever support arm and mounting flange in an installed position on a support member according to the principles of the present disclosure.
Figure 25A:
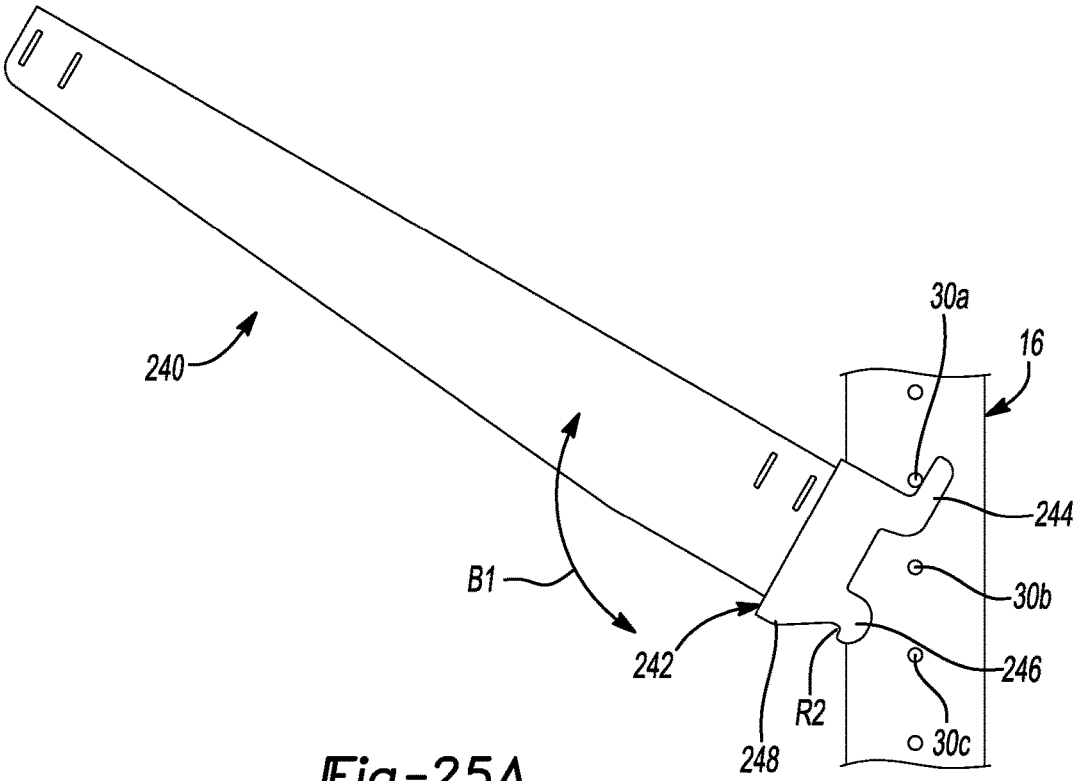
FIG. 25A and FIG. 25B illustrate installation and removal of the horizontal cantilever support arm and mounting flange of FIG. 24 relative to a support member.
Figure 25B:
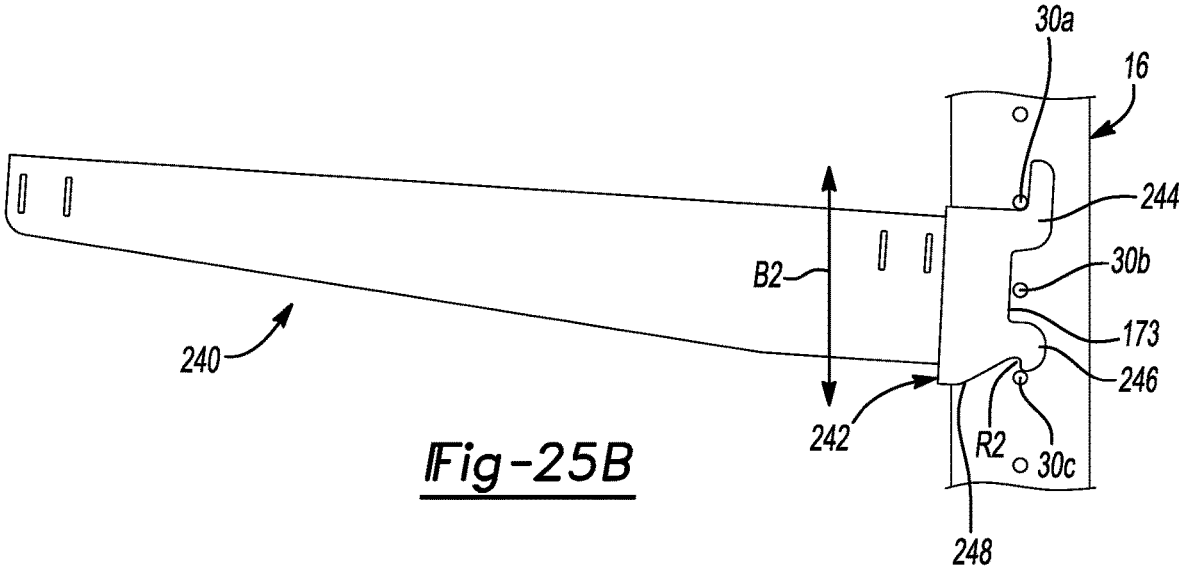

With reference to FIGS. 24 and 25A and 25B, still another example of a cantilever support arm 240 is shown. The cantilever support arm 240 is shown in an installed position on a support post 16. The cantilever support arm 240 can have many of the same characteristics of the cantilever support arms previously described. In this example, the cantilever support arm 240 is similar to the cantilever support arm 220 shown in FIG. 23. The cantilever support arm includes a mounting flange 242. The mounting flange 242 can include one or more of the previously described features. As shown, the mounting flange 242 can include a first finger portion 244. The first finger portion 244 can be installed between the hanger pins 30*a* and 30*b* as previously described. The mounting flange 242 can also include a second finger portion 246 including an edge 248. In the installed position (FIG. 24), the second finger portion 246 can be located at a vertical position between the hanger pins 30*b* and 30*c*. The edge 248 can contact or rest on a lower hanger pin 30*c* when the cantilever support arm 240 is in the installed position. With this configuration, a load L that may be exerted on the cantilever support arm 240 can be transferred to the first hanger pin 30*a* as force S1 and the second hanger pin 30*b* as force S4 (and/or to the front side 22 of the post 16 across the connecting face 291 of the mounting flange 242).

As shown in the figures, the edge 248 can define a curved and open hook-like section having a radius R2 (e.g., having a value approximately at least the same as a radius of the hanger pin 30*c*). The edge 248 can engage a portion of the circumference of the lower hanger pin 30*c*, particularly at a rear side of the hanger pin, to provide an anti-rotation function. With this anti-rotation feature, the cantilever support arm 240 in the installed position can resist a force F2 tending to pivot the cantilever support arm 240 in an upward direction (e.g., clockwise in FIG. 24). For example, an upward force F2 applied to a distal end 250 of the cantilever support arm 240 can be transferred to the lower hanger pin 30*c* as force S6.

As best seen in FIGS. 25A and 25B, installation and removal of the cantilever support arm 240 on the support post 16 involves both a pivoting or rotational movement and a vertical movement of the cantilever support arm 240, with reference to arrows B1 and B2. During installation of the cantilever support arm 240, the first finger portion 244 of cantilever support arm 240 is positioned between the two adjacent upper hanger pins 30*a* and 30*b* at a slightly upward angle (from horizontal) and then rotated downward (counter-clockwise, as shown in FIG. 25A) until the mounting flange 242 is positioned against the front side 22 of the vertical support post 16. Thereafter, the cantilever support arm 240 is moved vertically downwardly (as seen in FIG. 25B) so that the edge 248 engages and rests upon a lower hanger pin 30*c* (best seen in FIG. 24). Removal of the cantilever support arm is achieved in a manner reverse of installation.

Referring now to FIGS. 26-36, an example of a cantilever support arm assembly 300 for the cantilever shelving system 1 according to the principles of the present disclosure is shown. The cantilever support arm assembly 300 includes a cantilever support arm 302 and an anti-rotation member 304. The cantilever support arm 302 is shown in an installed position on a vertical support post 16. The cantilever support arm 302 can have many of the same features and characteristics of the cantilever support arms previously described. For example, the cantilever support arm 302 can be similar to the cantilever support arm 200 shown in FIG. 22.

Figure 27:
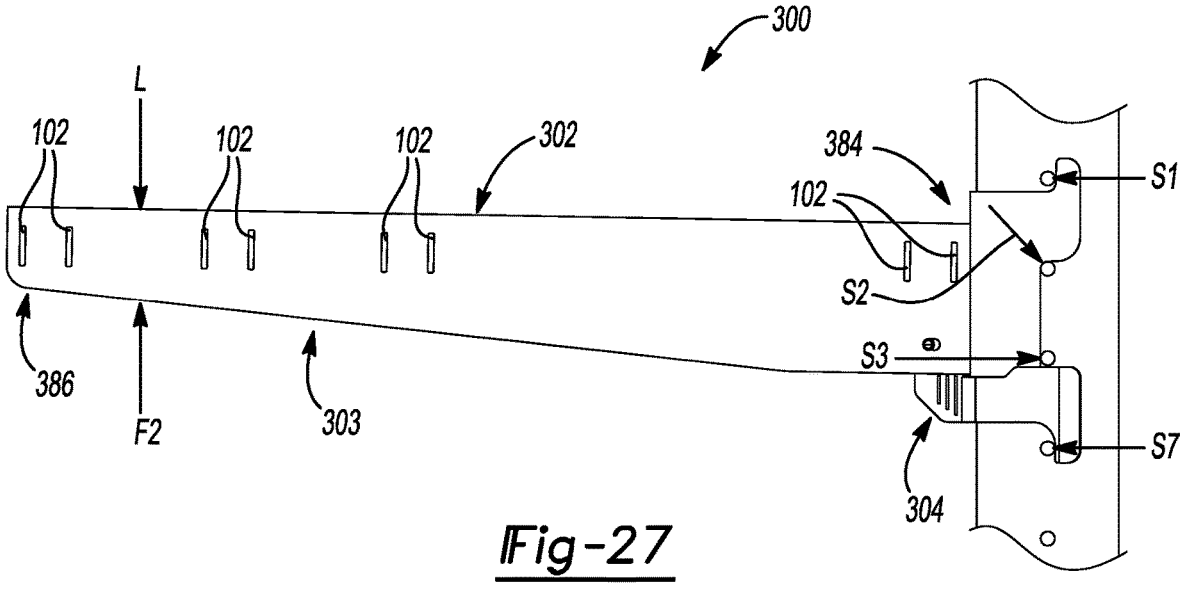
FIG. 27 shows a front view of the horizontal cantilever support arm assembly of FIG. 26.

In addition, as shown in FIGS. 26 and 27, the cantilever support arm 302 can include a plurality of elongated apertures or narrow slots 102 in each of the side walls 82 of the cantilever support arm 302. At least one narrow slot 102 can be included near the proximal end 84 of the cantilever support arm 302. Additional narrow slots 102 can be located at several positions 303 along the side walls 82 and toward the distal end 86 of the cantilever support arm. In one aspect, pairs of vertically extending and generally parallel narrow slots 102 can be included near each of the proximal and distal ends 84, 86 of each of the side walls 82 of the cantilever support arm 302, and further pairs of the slots 102 can be located at positions intermediate 303 to the proximal 384 and distal 386 ends of the cantilever support arm 302. In this manner, shelf support fittings 104 (e.g. FIG. 7) can be attached at various positions and spaced apart along the side walls 82. As can be appreciated, then, shelves 14 having various sizes/depths can be utilized with the cantilever shelving system. Moreover, the shelves 14 can be positioned at different locations between the proximal 384 and distal 386 ends of the cantilever support arm 302.

Further, the cantilever support arm assembly 300 can include an anti-rotation member 304, best seen in FIGS. 28-31. With the anti-rotation member 304, the cantilever support arm 302 can resist a force F2 (FIG. 27) having the potential to dislodge or detach the cantilever support arm 302 from its installation on a support post 16. In this respect, the anti-rotation member 304 can prevent the installed cantilever support arm 302 from pivoting in an upward direction (e.g., clockwise in FIG. 27) which could cause the mounting flange 342 to detach from the support post 16 and/or the hanger pins 30.

Figure 31:
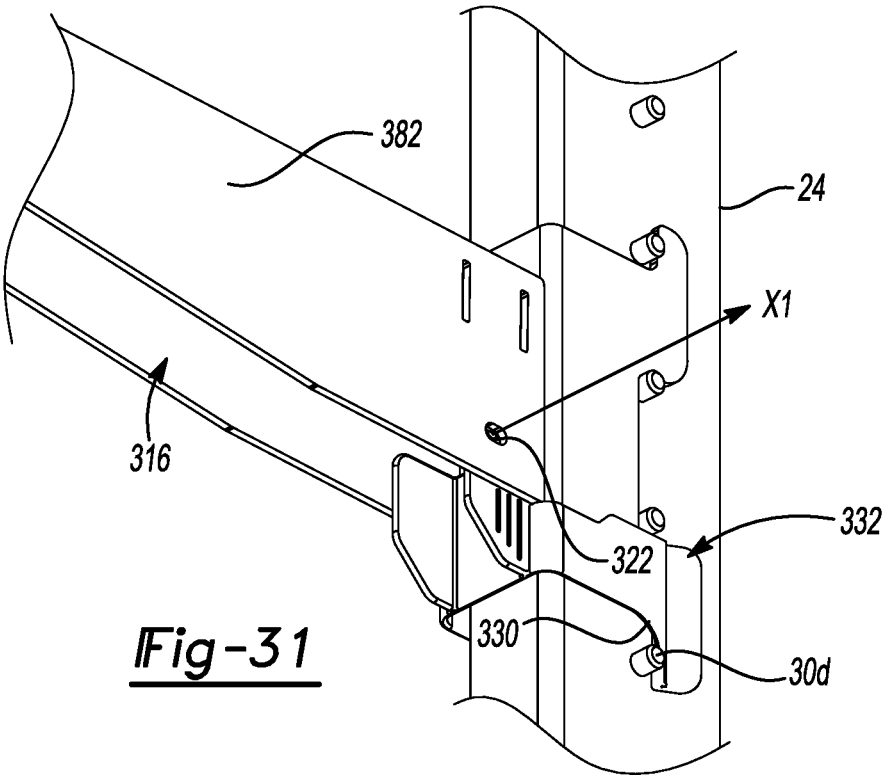
FIG. 31 shows a partial bottom-front-left side perspective view of the horizontal cantilever support arm assembly of FIG. 26.
Figure 32B:
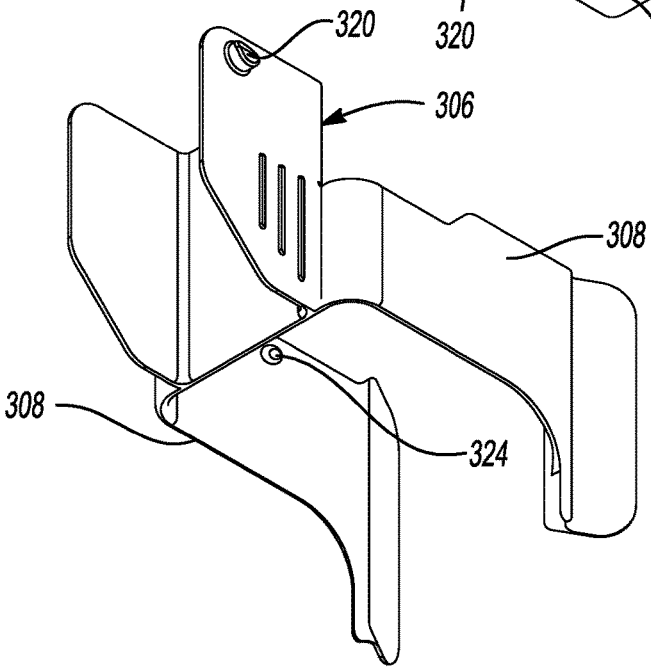
Figure 33A:
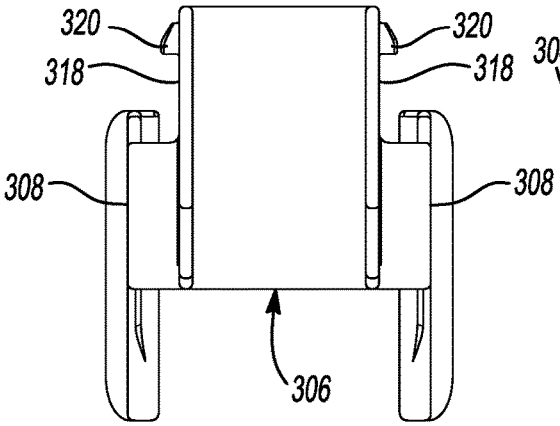
FIGS. 33A and 33B show front and right side views, respectively of the anti-rotation member of FIG. 32A.
Figure 33B:
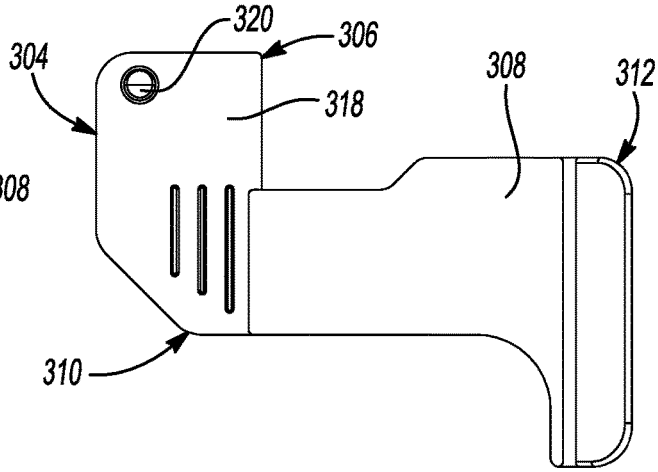

The anti-rotation member 304 is shown in detail in FIGS. 32A and 32B; 33A and 33B; and 34A and 34B. The anti-rotation member 304 includes a body portion 306 from which extend two opposed lateral side arms 308. The opposed lateral side arms 308 extend from the body portion 306 from a proximal end 310 to a distal end 312. As seen in FIGS. 28-31, in the installed position, each lateral side arm 308 extends over and along a respective side brace 314 of the mounting flange 342 and respective opposing lateral side 26 of the corresponding vertical support post 16.

Figure 30:
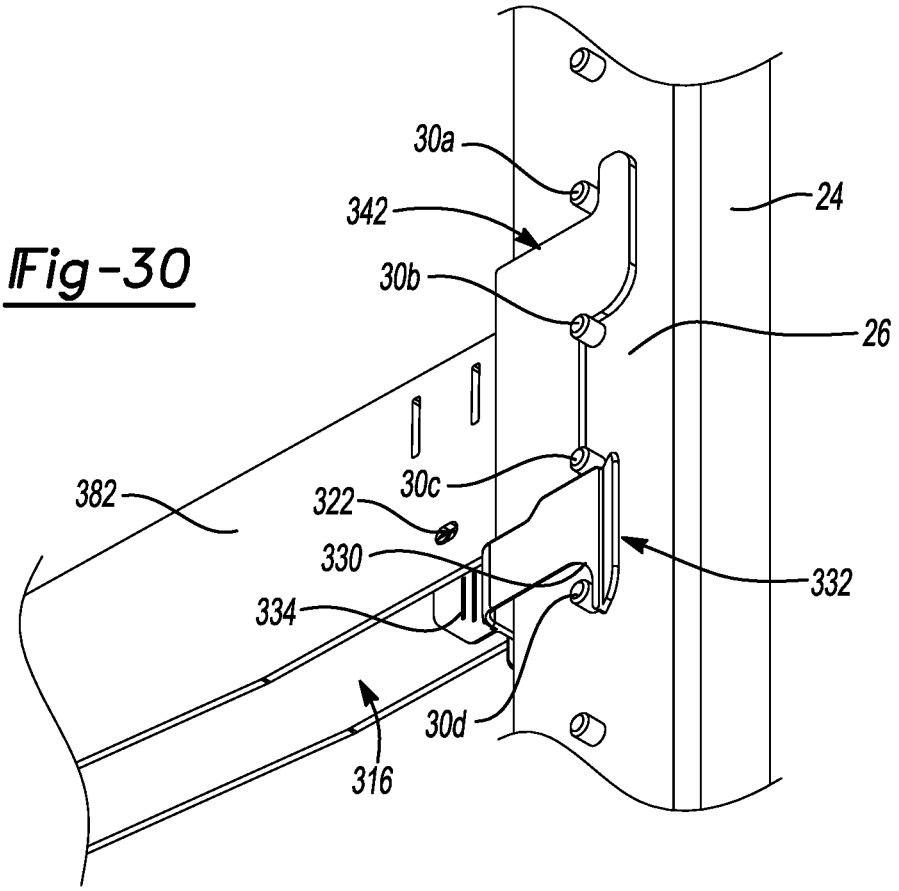
FIG. 30 shows a partial bottom-front-right side perspective view of the horizontal cantilever support arm assembly of FIG. 26.

The anti-rotation member can be attached to the cantilever support arm 302 and nested within the downwardly open channel 316 of the cantilever support arm and between the opposing side walls (see FIGS. 30, 31). The body portion 306 of anti-rotation member 304 has two opposing end walls 318. Each end wall 318 has at least one protrusion 320 at an upper end thereof. Assembled or attached to the cantilever support arm 302, the protrusions 320 on the body 706 of the anti-rotation member 304 engage respective openings or apertures 322 in the corresponding side walls 82 of the cantilever support arm 302. When assembled or attached to the cantilever support arm 302, the anti-rotation member 304 can pivot or rotate relative to the cantilever support arm 302 about an axis extending through the protrusions, as seen in FIG. 36A.

In addition, each of the side arms 308 has another protrusion 324 on an interior surface 326 of the side arm 308 nearer the proximal end 310 of the side arm 308. The protrusions 324 are configured to and can engage openings or apertures 328 in the corresponding side braces 314 of the mounting flange 342 of the cantilever support arm 302 (which are best seen in FIGS. 36A and 36B). When the protrusions 324 of the side arms 308 are engaged with the apertures 328 in the mounting flange 342 side braces 314, the engagement retains the anti-rotation member 304 in a fixed orientation relative to the cantilever support arm 302 and prevents or deters the anti-rotation member 304 from pivoting about the axis X extending through the protrusions 320 engaging the apertures 322 in the opposing side walls 382 of the cantilever support arm 302, as discussed above.

Figure 28:
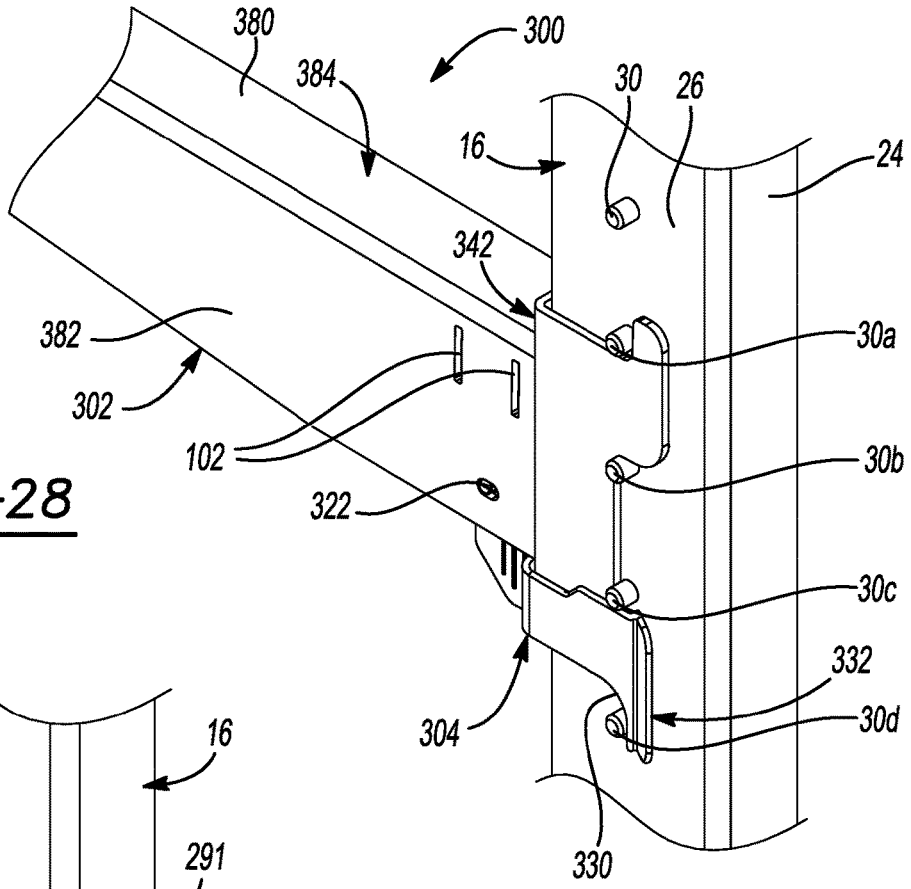
FIG. 28 shows a partial top-front-right side perspective view of the horizontal cantilever support arm assembly of FIG. 26.
Figure 29:
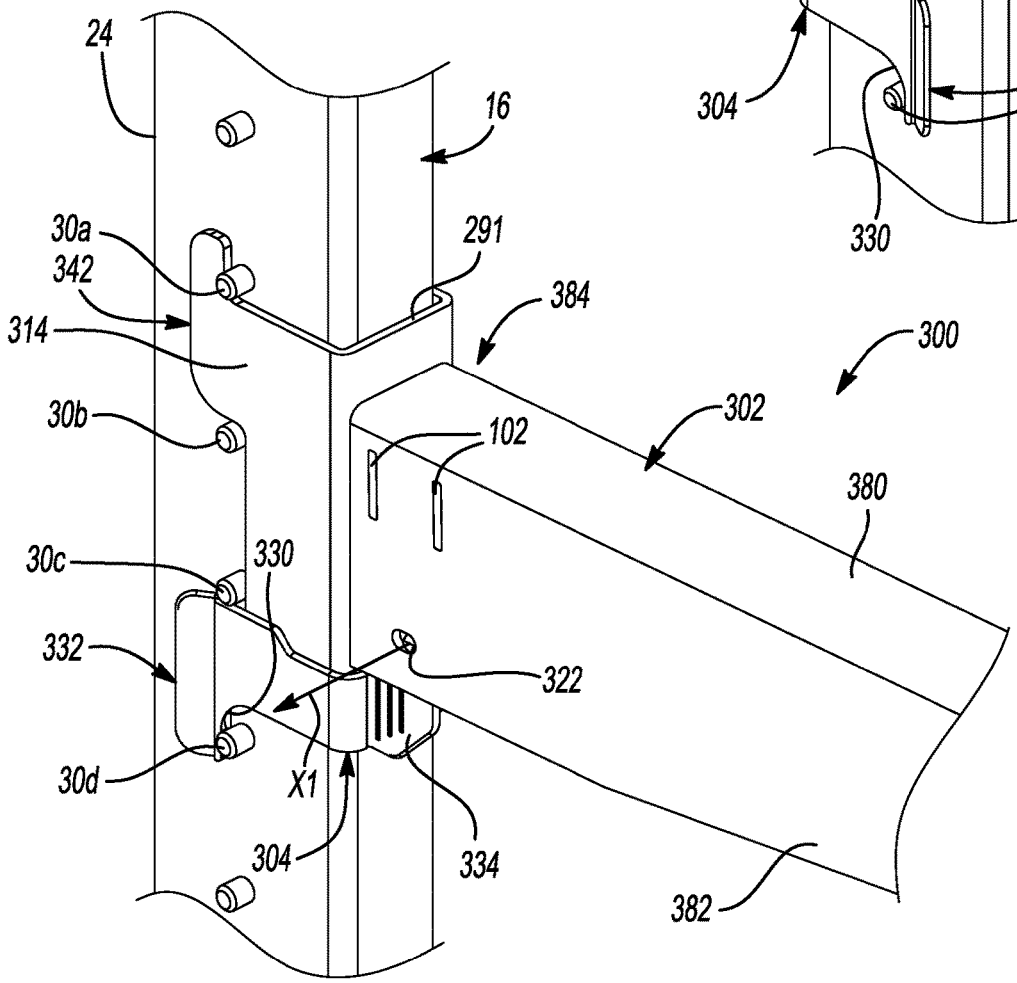
FIG. 29 shows a partial top-back-left side perspective view of the horizontal cantilever support arm assembly of FIG. 26.

At their distal ends 312, the lateral side arms 308 can define a forward-facing edge 330 which can extend generally vertically and is configured to bear against a side of an adjacent hanger pin 306 nearer the back side 24 of the support post 16. In addition, the distal ends 312 of the lateral side arms 308 include inwardly oriented or ramped engagement portions 332 which, when in the installed position, are positioned proximate to or can abut against the opposite sides 26 of the vertical support post 16 as shown in FIGS. 28 and 30. The ramped engagement portions 332 are also located rearward or behind the hanger pins 30 on the vertical support posts 16, as shown in FIGS. 28-31. With this configuration of the lateral side arms 308, the cantilever support arm 302 can resist a clockwise (e.g., in FIG. 27) rotation which may have the tendency to dislodge the cantilever support arm 302 from its mounting on the vertical support post, such as if the cantilever support arm 302 were subjected to an upward force F2 near a distal end 388 of the cantilever support arm 302. In such a case, the lateral side arms 308 of the anti-rotation member 304 are configured to bear against a side of a hanger pin 30*d* nearer the back side 24 of the support post 16 and prevent such rotation. For example, an upward force F2 applied to a distal end 386 of the cantilever support arm 302 can be transferred to the back side of the lower hanger pin 30*d* by the anti-rotation member as force S7 (FIG. 27).

The anti-rotation member 304 can be made from a sturdy plastic material so that it is flexible and resilient. With such a construction, the side arms 308 are able to flex outwardly (e.g., around and/or over the hanger pins 30) during installation and "snap back" resiliently to an installed position. A ribbed or raised surface 334 on the body portion 306 of the anti-rotation member 304 can provide a handling or engagement area with a tactile feedback to a user.

Installation of the cantilever support arm assembly 300 can be seen in FIGS. 35A and 35B. During installation, the anti-rotation member 304 can be fixed relative to the cantilever support arm 302 (e.g., the protrusions 324 of the side arms 308 are engaged with the apertures 328 in the mounting flange 342 side braces 314) such that the side arms 308 are generally parallel to an upper surface 380 of the cantilever support arm 302, as shown in FIGS. 35A and 35B. As previously described, the finger portion 344 of the side brace 314 of the mounting flange 342 of the cantilever support arm 302 is moved to a position between two adjacent upper hanger pins 30*a* and 30*b* while the cantilever support arm 302 is positioned at a slight upward angle (from horizontal) as shown in FIG. 35A. The cantilever support arm 302 is then rotated downward (counter-clockwise in FIGS. 35A-B) as shown by arrow C1. The ramped engagement portions 332 of the side arms 308 of the anti-rotation member 304 engage against the lower hanger pins 30*d* (e.g., on opposite sides 26 of the vertical support post 16) causing the side arms 308 to flex outwardly, enabling the side arms 308 to pass over lower hanger pins 30*d*. Further rotation of the support arm 302 moves the side arms 308 past the hanger pins 30*d*. The side arms 308 then resiliently snap back into an installed position at a rearward side of the lower hanger pins 30*d*. In this installed condition, the mounting flange 342 is positioned against the vertical support post 16. Once installed, as shown in the figures, including FIG. 35B, the anti-rotation member 304 assembled to the cantilever support arm 302, resists a clockwise rotation of the cantilever support arm assembly 300 such as may result from an upward force F2 being applied to a distal end 386 of the cantilever support arm 302.

Removal and separation of the cantilever support arm assembly 300 from the vertical support post 16 is illustrated in FIGS. 36A and 36B. First, the anti-rotation member 304 is disengaged from the vertical support post 16. In this respect, the opposing side arms 308 of the anti-rotation member 304 are flexed outwardly by moving the distal ends 312 of the side arms 308 away from the opposing sides 26 of the vertical support post 16. The ramped engagement portions 332 at the distal ends 312 of the opposing side arms 308 enable a user to flex the side arms 308 easily. Once the side arms 308 are flexed outwardly, the protrusions 324 on the inner surface 326 of the side arms 308 can disengage from the openings 328 in the side braces 314 of the mounting flange 342 of the cantilever support arm 302 and pass over the hanger pins 30*d* as the anti-rotation member 304 simultaneously pivots about the axis X passing through the protrusions 320 on the end walls 318 of the body 306, downwardly in a clockwise direction of arrow C2 as shown in FIG. 36A. Thereafter, the cantilever support arm 302 can be rotated in a clockwise direction (see arrow C3, FIG. 36B) and be removed from the vertical support post 16 as the finger portion 344 passes between the two upper hanger pins 30*a*, 30*b* in a manner reverse of installation.

All of the previously described mounting flanges can secure the respective cantilever support arms into position relative to the vertical support post 16. The cantilever support arms can be easily installed, removed and/or repositioned using the hanger pins 30. Further, the cantilever support arms and cantilever support arm assembly can resist becoming dislodged from the vertical support post with the features described herein, including the anti-rotation members, which oppose forces tending to pivot the cantilever support arm in an upward direction, such as an upward force applied to a distal end of the cantilever support arm.

As can be appreciated, the anti-rotation member may be disassembled from and is completely separable from the cantilever support arm, the resilience of the anti-rotation member and the respective protrusions in the body portion and the side arms retaining the anti-rotation member with the cantilever support arm.

With reference to FIGS. 37, 38A and 38B, and 39A and 39B, an alternate embodiment of a cantilever support arm assembly 400 having an alternate anti-rotation member 404 is shown. The cantilever support arm 402 is substantially the same as discussed above. Similar to the anti-rotation member 304, the anti-rotation member 404 includes a body portion 406 from which extend two opposed lateral side arms 408. However, as illustrated in FIG. 37, in the installed position, each lateral side arm 408 extends along a respective opposing lateral side 26 of the corresponding vertical support post 16 but beneath a respective side brace 414 of the mounting flange 442. Consequently, the side arms 418 do not engage the side braces 414 of the mounting flange 442. Therefore, as seen in FIGS. 39A and 39B, the interior surfaces 426 of the side arms 418 do not include any inwardly extending protrusions with which to engage apertures in the side braces, as in the anti-rotation member 304 described above.

Additionally, the anti-rotation member 404 can include a cross brace 436 located between the two opposing walls 418 of the body 406. The cross brace 436 can serve to increase the stiffness of the body 406 of the anti-rotation member 404 and, accordingly, the robustness of the support arm assembly 400.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cantilever shelving system of the type that is free-standing on a floor surface, the cantilever shelving system comprising:

a frame comprising a plurality of laterally-spaced, vertically-oriented support members, the plurality of support members including at least a front side, opposing lateral sides and plurality of vertically-spaced hanger pins projecting outwardly from the opposing lateral sides wherein the front sides of at least two of the plurality of support members lie in a common plane;

a plurality of base supports adapted to engage the floor surface, wherein each of the plurality of base supports is connected to a corresponding one of the plurality of support members;

a cantilever shelf support mounted to the frame including an elongated portion extending in a forward from the common plane, the elongated portion having a side wall including at least one slot in the side wall and at least one shelf support fitting attached to the cantilever shelf support at the at least one slot;

the cantilever shelf support further comprising a mounting flange having opposing lateral side braces extending in a rearward direction from the common plane and a connecting portion between the lateral side braces, wherein each of the lateral side braces comprises a finger portion extending vertically upward from a rearward end of the lateral side brace and an edge at the rearward end of the lateral side brace;

wherein, when mounted to the frame, each finger portion of the opposing lateral side braces extends along a respective opposing lateral side of a corresponding support member and between first and second vertically-adjacent hanger pins of the plurality of vertically-spaced hanger pins of the support member, the first hanger pin being located vertically above the second hanger pin; and wherein a first end of each finger portion bears against a rearward side of the first hanger pin; and wherein at least one of a second end of each finger portion and the edge at the rearward end of the lateral side brace bears against the second hanger pin.

2. The cantilever shelving system of claim 1, wherein the second end of the finger portion comprises a first base edge that bears against the second hanger pin, the first base edge comprising a radius that is substantially the same as a radius of the second hanger pin.

3. The cantilever shelving system of claim 1, wherein the edge at the rearward end of the lateral side brace extends vertically below the second hanger pin; and wherein the edge at the rearward end of the lateral side brace bears against a forward side of the second hanger pin.

4. The cantilever shelving system of claim 3, wherein each of the lateral side braces further comprises a second finger portion extending vertically downward from the rearward end of the lateral side brace;

wherein the second finger portion comprises a second base edge comprising an arcuate portion that bears against a third hanger pin of the plurality of vertically-spaced hanger pins of the corresponding support member that is located vertically below the second hanger pin.

5. The cantilever shelving system of claim 4, wherein the arcuate portion comprises a radius greater than a radius of the third hanger pin.

6. The cantilever shelving system of claim 4, wherein the arcuate portion comprises a radius substantially the same as a radius of the third hanger pin.

7. The cantilever shelving system of claim 4 further comprising an anti-rotation member that is attached to the cantilever shelf support and, in an installed position, is configured to bear against a fourth hanger pin of the plurality of vertically-spaced hanger pins of the corresponding support member that is located vertically below the third hanger pin when an upward force is applied to a distal end of the cantilever shelf support;

wherein the anti-rotation member comprises:

a body;

two opposed lateral side arms, each lateral side arm extending from the body from a proximal end to a distal end;

wherein, in the installed position, each lateral side arm extends adjacent to a respective opposing lateral side of the corresponding support member; and wherein each distal end of each lateral side arm is positioned rearward of a rearward side of the fourth hanger pin.

8. The cantilever shelving system of claim 1, wherein the edge at the rearward end of the lateral side brace extends vertically below a third hanger pin of the plurality of vertically-spaced hanger pins of the corresponding support member that is located vertically below the second hanger pin.

9. The cantilever shelving system of claim 8, wherein the edge at the rearward end of the lateral side brace bears against a forward side of the third hanger pin.

10. The cantilever shelving system of claim 8, wherein the connecting portion of the cantilever shelf support bears against the front side of the support member.

11. The cantilever shelving system of claim 10, wherein the edge at the rearward end of the lateral side brace bears against a forward side of the third hanger pin.

12. The cantilever shelving system of claim 8 further comprising an anti-rotation member that is attached to the cantilever shelf support and, in an installed position, is bearing against a fourth hanger pin of the plurality of vertically-spaced hanger pins of the corresponding support member, wherein the fourth hanger pin is located vertically below the third hanger pin;

wherein the anti-rotation member comprises:

a body;

two opposed lateral side arms, each lateral side arm extending from the body from a proximal end to a distal end;

wherein, in the installed position, each lateral side arm extends adjacent to a respective opposing lateral side of the corresponding support member; and wherein each distal end of each lateral side arm is positioned rearward of a rearward side of the fourth hanger pin.

13. The cantilever shelving system of claim 12 wherein the distal end of each lateral side arm comprises a ramped engagement portion which, in the installed position, bears against a respective one of the opposing lateral sides of the corresponding support member.

14. The cantilever shelving system of claim 12 wherein the elongated portion of the cantilever shelf support comprises a pair of opposing lateral side walls defining a downwardly open channel, each of the pair of opposing side walls comprising an aperture near a proximal end thereof;

wherein the body of the anti-rotation member comprises two opposing walls, wherein each opposing wall comprises a protrusion thereon;

wherein the body is disposed within the downwardly open channel;

wherein the protrusion on each opposing wall of the body engages the aperture in a corresponding side wall of the elongated portion of the cantilever shelf support; and wherein the anti-rotation member is pivotable about an axis extending through the protrusions on the opposing walls of the body of the anti-rotation member.

15. The cantilever shelving system of claim 14 wherein the body of the anti-rotation member comprises a stiffener located between the opposing walls of the body.

16. The cantilever shelving system of claim 15 wherein the distal end of each lateral side arm comprises a ramped engagement portion which, in the installed position, bears against a respective one of the opposing lateral sides of the corresponding support member.

17. The cantilever shelving system of claim 14 wherein at least one of the side braces further comprises a second aperture therein;

wherein at least one of the lateral side arms comprises a second protrusion nearer to the proximal end thereof;

wherein the second protrusion is configured to engage the second aperture; and wherein, when the second protrusion is engaged with the second aperture, the anti-rotation member is prevented from pivoting about the axis.

18. The cantilever shelving system of claim 17 wherein the distal end of each lateral side arm comprises a ramped engagement portion which, in the installed position, bears against a respective one of the opposing lateral sides of the corresponding support member.

19. The cantilever shelving system of claim 1, further comprising a wedge member disposed between the side wall of the cantilever shelf support and the shelf support fitting, the wedge member preventing the shelf support fitting from detaching from the cantilever shelf support.

20. The cantilever shelving system of claim 19, wherein the wedge member comprises a tapered leading portion, the tapered leading portion configured to guide the wedge member into a seated position between the cantilever shelf support the shelf support fitting; and wherein the wedge member comprises at least one pad projecting away from a body portion of the wedge member, the pad adapted to engage the at least one slot in the side wall of the cantilever shelf support when the wedge member is in a seated position.

* * * * *